US008179358B2

(12) United States Patent
Yajima et al.

(10) Patent No.: US 8,179,358 B2
(45) Date of Patent: May 15, 2012

(54) DISPLAY DEVICE, INTEGRATED CIRCUIT DEVICE, AND ELECTRONIC INSTRUMENT

(75) Inventors: Hidehiko Yajima, Suwa (JP); Hiroshi Kiya, Suwa (JP)

(73) Assignee: Seiko Epson Corporation (JP)

( * ) Notice: Subject to any disclaimer, the term of this patent is extended or adjusted under 35 U.S.C. 154(b) by 1141 days.

(21) Appl. No.: 11/998,970

(22) Filed: Dec. 3, 2007

(65) Prior Publication Data

US 2008/0136847 A1 Jun. 12, 2008

(30) Foreign Application Priority Data

Dec. 6, 2006 (JP) ..... 2006-329140

(51) Int. Cl.
*G09G 3/36* (2006.01)

(52) U.S. Cl. ..... 345/100; 345/205

(58) Field of Classification Search ..... 345/49, 345/50, 205–206; 349/149–152
See application file for complete search history.

(56) References Cited

U.S. PATENT DOCUMENTS

| | | | | |
|---|---|---|---|---|
| 5,867,057 | A | 2/1999 | Hsu et al. | |
| 7,034,797 | B2 | 4/2006 | Maki | |
| 7,839,479 | B2 * | 11/2010 | Choi | 349/152 |
| 2002/0011998 | A1 | 1/2002 | Tamura | |
| 2002/0051114 | A1 * | 5/2002 | Kwak et al. | 349/192 |
| 2004/0017341 | A1 | 1/2004 | Maki | |
| 2004/0113880 | A1 * | 6/2004 | Honda | 345/96 |
| 2004/0119824 | A1 * | 6/2004 | Osada | 348/180 |
| 2005/0083444 | A1 * | 4/2005 | Chen et al. | 349/40 |
| 2007/0001973 | A1 | 1/2007 | Kumagai et al. | |
| 2007/0001982 | A1 | 1/2007 | Ito et al. | |
| 2007/0002033 | A1 * | 1/2007 | Komatsu et al. | 345/204 |
| 2007/0002061 | A1 | 1/2007 | Kumagai et al. | |
| 2007/0057826 | A1 | 3/2007 | Yajima et al. | |
| 2008/0117234 | A1 * | 5/2008 | Yajima et al. | 345/690 |

FOREIGN PATENT DOCUMENTS

| | | | |
|---|---|---|---|
| CN | 1384603 | A | 12/2002 |
| CN | 1467693 | A | 1/2004 |
| JP | 2001/222249 | | 8/2001 |
| JP | 2007/012869 | | 1/2007 |
| JP | 2007/043029 | | 2/2007 |
| JP | 2007/043030 | | 2/2007 |
| JP | 2007/043031 | | 2/2007 |
| JP | 2007/043032 | | 2/2007 |
| JP | 2007/043033 | | 2/2007 |
| JP | 2007/043034 | | 2/2007 |
| JP | 2007/043035 | | 2/2007 |
| JP | 2007/043036 | | 2/2007 |
| JP | 2007/065322 | | 3/2007 |

* cited by examiner

*Primary Examiner* — Chanh Nguyen
*Assistant Examiner* — Roy Rabindranath
(74) *Attorney, Agent, or Firm* — Harness, Dickey & Pierce, P.L.C.

(57) ABSTRACT

A display device includes an integrated circuit device and a display panel. The display panel includes a panel test terminal that is used to test the display panel, and a driver output terminal that is electrically connected with a data driver pad of the integrated circuit device and is electrically connected with the panel test terminal. The integrated circuit device includes a data driver block and a high-speed I/F circuit block including a physical layer circuit. The physical layer circuit is disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel.

4 Claims, 24 Drawing Sheets

FIG. 19A

FIG. 19B

DISPLAY DEVICE, INTEGRATED CIRCUIT DEVICE, AND ELECTRONIC INSTRUMENT

Japanese Patent Application No. 2006-329140 filed on Dec. 6, 2006, is hereby incorporated by reference in its entirety.

BACKGROUND OF THE INVENTION

The present invention relates to a display device, an integrated circuit device, an electronic instrument, and the like.

In recent years, a high-speed serial transfer such as low voltage differential signaling (LVDS) has attracted attention as an interface aiming at reducing EMI noise or the like. In such a high-speed serial transfer, data is transferred by causing a transmitter circuit to transmit serialized data using differential signals and causing a receiver circuit to differentially amplify the differential signals.

An ordinary portable telephone includes a first instrument section provided with buttons for inputting a telephone number and characters, a second instrument section provided with a liquid crystal display (LCD) and a camera device, and a connection section (e.g., hinge) which connects the first and second instrument sections. Therefore, the number of interconnects passing through the connection section can be reduced by transferring data between a first circuit board provided in the first instrument section and a second circuit board provided in the second instrument section by a high-speed serial transfer using small-amplitude differential signals.

A display driver (LCD driver) is known as an integrated circuit device which drives a display panel such as a liquid crystal panel. In order to realize a high-speed serial transfer between the first and second instrument sections, a high-speed interface circuit which transfers data through a serial bus must be incorporated in the display driver (see JP-A-2001-222249).

On the other hand, since the high-speed interface circuit handles differential signals with a small voltage amplitude of 0.1 to 1.0 V, for example, the high-speed interface circuit tends to be affected by noise from other signal lines. In order to prevent a decrease in yield, it is desirable to individually test the display panel before mounting the integrated circuit device on the display panel.

SUMMARY

According to one aspect of the invention, there is provided a display device comprising:

an integrated circuit device; and a display panel that is driven by the integrated circuit device, the integrated circuit device being mounted on the display panel, the display panel including:

a panel test terminal that is used to test the display panel; and a driver output terminal that is electrically connected with a data driver pad of the integrated circuit device and is electrically connected with the panel test terminal, the integrated circuit device including:

at least one data driver block that drives a data line of the display panel; and a high-speed interface circuit block that includes a physical layer circuit and transfers data through a serial bus using differential signals, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel.

According to anther aspect of the invention, there is provided a display device comprising:

an integrated circuit device; and a display panel that is driven by the integrated circuit device, the integrated circuit device being mounted on the display panel, the display panel including:

a panel test terminal that is used to test the display panel; and a driver output terminal that is electrically connected with a data driver pad of the integrated circuit device and is electrically connected with the panel test terminal, the integrated circuit device including:

at least one data driver block that drives a data line of the display panel; and a high-speed interface circuit block that includes a physical layer circuit and transfers data through a serial bus using differential signals, a panel common voltage line being provided so that the panel common voltage line non-overlaps a predetermined physical layer region, the predetermined physical layer region being a region in which the physical layer circuit is predetermined to locate over the display panel when the integrated circuit device is mounted on the display panel.

According to a further aspect of the invention, there is provided an integrated circuit device that is mounted on a display device and drives the display device, the integrated circuit device comprising:

at least one data driver block that drives a data line of the display panel; and a high-speed interface circuit block that includes a physical layer circuit and transfers data through a serial bus using differential signals, the display device including:

a panel test terminal that is used to test the display panel;

a driver output terminal that is electrically connected with a data driver pad of the integrated circuit device and is electrically connected with the panel test terminal, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel.

According to a further aspect of the invention, there is provided an electronic instrument comprising the above display device.

According to a further aspect of the invention, there is provided an electronic instrument comprising: the above integrated circuit device; and the display panel driven by the integrated circuit device.

BRIEF DESCRIPTION OF THE SEVERAL VIEWS OF THE DRAWING

FIGS. 19A and 19B are views illustrative of an arrangement method for a grayscale voltage generation circuit block.

DETAILED DESCRIPTION OF THE EMBODIMENT

Figure 1:
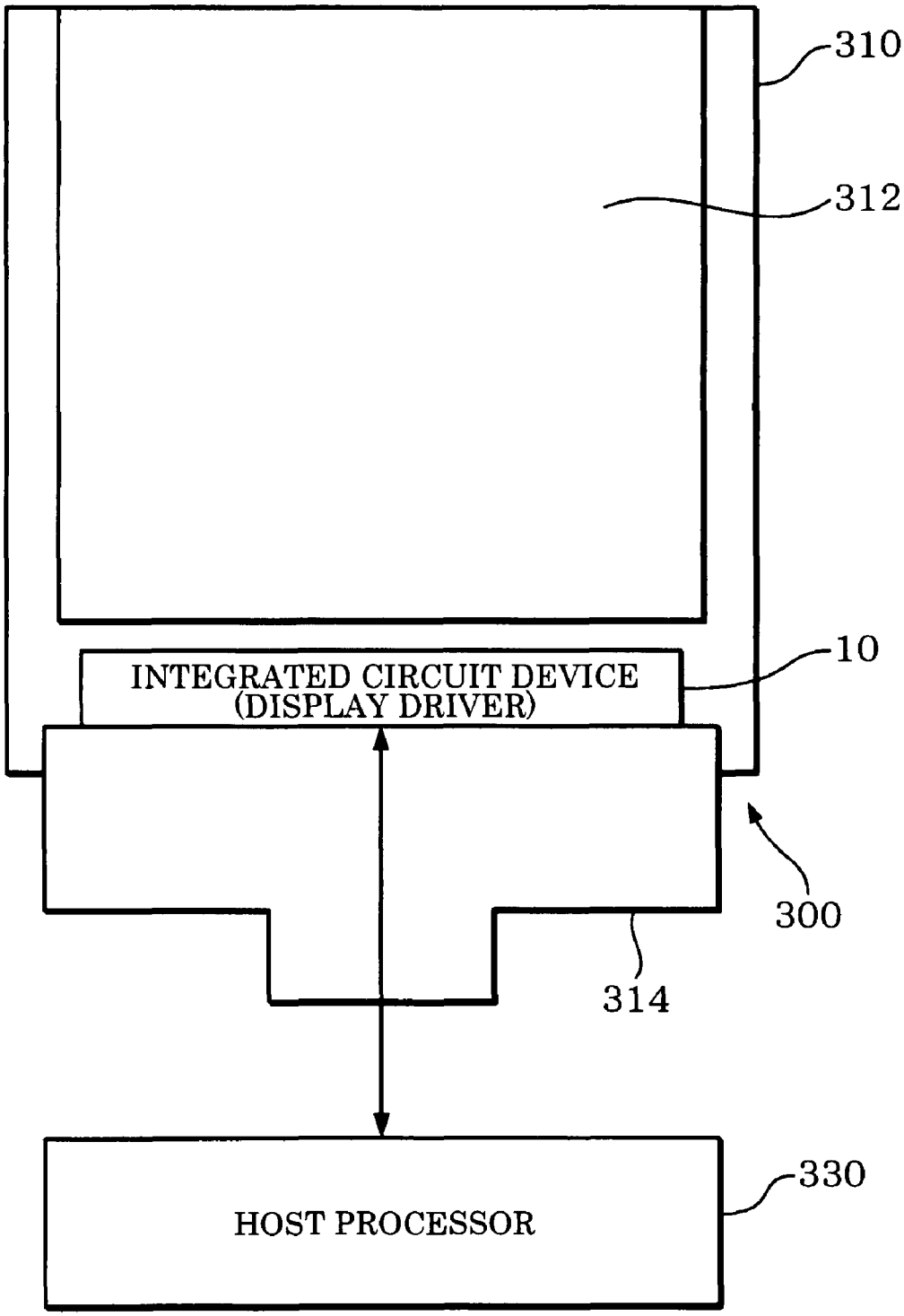
FIG. 1 shows an example of a display panel on which an integrated circuit device is mounted.

Aspects of the invention may provide a display device which can prevent a malfunction and the like when incorporating a high-speed interface circuit, an integrated circuit device, and an electronic instrument.

According to one embodiment of the invention, there is provided a display device comprising:

an integrated circuit device; and a display panel that is driven by the integrated circuit device, the integrated circuit device being mounted on the display panel, the display panel including:

a panel test terminal that is used to test the display panel; and a driver output terminal that is electrically connected with a data driver pad of the integrated circuit device and is electrically connected with the panel test terminal, the integrated circuit device including:

at least one data driver block that drives a data line of the display panel; and a high-speed interface circuit block that includes a physical layer circuit and transfers data through a serial bus using differential signals, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel.

According to this embodiment, since the display panel includes the panel test terminal, the display panel can be tested in a state in which the integrated circuit device is not mounted on the display panel. According to this embodiment, the physical layer circuit is disposed in a region which does not overlap the predetermined test terminal region which is a region in which the panel test terminal is located during mounting. This prevents a situation in which signal noise from the panel test terminal electrically connected with the driver output terminal adversely affects the physical layer circuit, whereby a malfunction and the like when incorporating the high-speed interface circuit can be prevented.

In the display device according to this embodiment, the high-speed interface circuit block may include a link controller that performs a link layer process, the link controller being disposed in a region that overlaps the predetermined test terminal region.

According to this configuration, since the predetermined test terminal region can be set by effectively utilizing the arrangement region of the link controller, the layout efficiency can be increased while preventing a malfunction of the physical layer circuit.

In the display device according to this embodiment, when a direction from a first side that is a short side of the integrated circuit device toward a third side opposite to the first side is referred to as a first direction and a direction from a second side that is a long side of the integrated circuit device toward a fourth side opposite to the second side is referred to as a second direction, the link controller may be disposed in the second direction with respect to the physical layer circuit, and the driver output terminal may be disposed in the second direction with respect to the panel test terminal.

According to this configuration, since the link controller can be disposed by effectively utilizing the region in the second direction with respect to the physical layer circuit and the arrangement region of the link controller can be set in the predetermined test terminal region, the layout efficiency can be increased while preventing a malfunction of the physical layer circuit.

In the display device according to this embodiment, a panel common voltage line may be provided so that the panel common voltage line non-overlaps a predetermined physical layer region, the predetermined physical layer region being a region in which the physical layer circuit is predetermined to locate over the display panel when the integrated circuit device is mounted on the display panel.

According to another embodiment of the invention, there is provided a display device comprising:

an integrated circuit device; and a display panel that is driven by the integrated circuit device, the integrated circuit device being mounted on the display panel, the display panel including:

a panel test terminal that is used to test the display panel; and a driver output terminal that is electrically connected with a data driver pad of the integrated circuit device and is electrically connected with the panel test terminal, the integrated circuit device including:

at least one data driver block that drives a data line of the display panel; and a high-speed interface circuit block that includes a physical layer circuit and transfers data through a serial bus using differential signals, a panel common voltage line being provided so that the panel common voltage line non-overlaps a predetermined physical layer region, the predetermined physical layer region being a region in which the physical layer circuit is predetermined to locate over the display panel when the integrated circuit device is mounted on the display panel.

According to this embodiment, the panel common voltage line is provided to avoid the physical layer circuit. Specifically, since the panel common voltage line is not provided under the physical layer circuit, a situation can be prevented in which signal noise from the panel common voltage line is transmitted to the physical layer circuit, whereby the physical layer circuit malfunctions.

In the display device according to this embodiment, the panel common voltage line may be provided in a region between the predetermined physical layer region and the panel test terminal.

This prevents the panel common voltage line from intersecting the panel test terminal, whereby the wiring efficiency can be increased.

In the display device according to this embodiment, the integrated circuit device may include:

a common voltage generation circuit that generates a common voltage applied to a common electrode of the display panel; and first and second common voltage pads that output the common voltage generated by the common voltage generation circuit to the outside, when a direction from a first side that is a short side of the integrated circuit device toward a third side opposite to the first side is referred to as a first direction, a direction from a second side that is a long side of the integrated circuit device toward a fourth side opposite to the second side is referred to as a second direction, a direction opposite to the first direction is referred to as a third direction, and a direction opposite to the second direction is referred to as a fourth direction, the first common voltage pad may be disposed in the third direction with respect to the data driver block, and the second common voltage pad may be disposed in the first direction with respect to the data driver block, the integrated circuit device may further include:

first and second differential input pads disposed in the fourth direction with respect to the physical layer circuit, first and second signals forming the differential signals being input to the first and second differential input pads from the outside; and a common voltage line that connects the first and second common voltage pads, the common voltage line being provided from the first common voltage pad to the second common voltage pad along the first direction, and the common voltage line being provided in the second direction with respect to the physical layer circuit along the first direction in an arrangement region of the physical layer circuit.

According to this embodiment, the first and second common voltage pads are connected through the common voltage line. Therefore, deterioration in display quality due to the imbalanced parasitic resistance of the common voltage line can be reduced. The common voltage line is provided in the second direction with respect to the physical layer circuit along the first direction. Therefore, noise from the common voltage line can be prevented from being superimposed on the differential signals of the physical layer circuit, whereby a malfunction of the high-speed interface circuit due to noise can be prevented.

According to a further embodiment of the invention, there is provided an integrated circuit device that is mounted on a display device and drives the display device, the integrated circuit device comprising:

at least one data driver block that drives a data line of the display panel; and a high-speed interface circuit block that includes a physical layer circuit and transfers data through a serial bus using differential signals, the display device including:

a panel test terminal that is used to test the display panel; and a driver output terminal that is electrically connected with a data driver pad of the integrated circuit device and is electrically connected with the panel test terminal, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel.

In the integrated circuit device according to this embodiment, the integrated circuit device may include:

first to Nth circuit blocks (N is an integer equal to or larger than two) disposed along a first direction, the first to Nth circuit blocks including:

the data driver block;

a grayscale voltage generation circuit block that generates a plurality of grayscale voltages; and a logic circuit block that receives data received by the high-speed interface circuit block and transfers grayscale adjustment data for adjusting the plurality of grayscale voltages to the grayscale voltage generation circuit block, when a direction from a first side that is a short side of the integrated circuit device toward a third side opposite to the first side is referred to as the first direction, a direction from a second side that is a long side of the integrated circuit device toward a fourth side opposite to the second side is referred to as a second direction, a direction opposite to the first direction is referred to as a third direction, and a direction opposite to the second direction is referred to as a fourth direction, the grayscale voltage generation circuit block may be disposed in the third direction with respect to the data driver block, and the high-speed interface circuit block and the logic circuit block may be disposed in the first direction with respect to the data driver block.

According to this configuration, since the first to Nth circuit blocks are disposed along the first direction, the width of the integrated circuit device in the second direction can be reduced, whereby a reduction in area can be achieved. Moreover, interconnects can be provided utilizing the free space in the second direction with respect to the grayscale voltage generation circuit block and the logic circuit block, whereby the wiring efficiency can be increased. Furthermore, since the data driver block can be disposed around the center of the integrated circuit device, data signal output lines from the data driver block can be efficiently and simply provided.

In the integrated circuit device according to this embodiment, the integrated circuit device may include:

local lines provided between adjacent circuit blocks among the first to Nth circuit blocks, the local lines being formed of an interconnect layer lower than an Ith (I is an integer equal to or larger than three) layer;

global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and grayscale global lines that supplies the plurality of grayscale voltages from the grayscale voltage generation circuit block to the data driver, the grayscale global lines being provided over the data driver block along the first direction.

This allows the adjacent circuit blocks to be connected through the local line along a short path, whereby an increase in chip area due to an increase in wiring region can be prevented. Moreover, since the global line is provided between the nonadjacent circuit blocks, the grayscale global line can be provided over the local lines, even if the number of local lines is large.

In the integrated circuit device according to this embodiment, the integrated circuit device may include:

first to Nth circuit blocks (N is an integer equal to or larger than two) disposed along a first direction, the first to Nth circuit blocks including:

the data driver block;

a power supply circuit block that generates a power supply voltage; and a logic circuit block that receives data received by the high-speed interface circuit block and transfers power supply adjustment data for adjusting the power supply voltage to the power supply circuit block, when a direction from a first side that is a short side of the integrated circuit device toward a third side opposite to the first side is referred to as the first direction, a direction from a second side that is a long side of the integrated circuit device toward a fourth side opposite to the second side is referred to as a second direction, a direction opposite to the first direction is referred to as a third direction, and a direction opposite to the second direction is referred to as a fourth direction, the power supply circuit block may be disposed in the third direction with respect to the data driver block, and the high-speed interface circuit block and the logic circuit block may be disposed in the first direction with respect to the data driver block.

According to this configuration, interconnects can be provided utilizing the free space in the second direction with respect to the power supply circuit block and the logic circuit block, whereby the wiring efficiency can be increased.

In the integrated circuit device according to this embodiment, the integrated circuit device may include:

local lines provided between adjacent circuit blocks among the first to Nth circuit blocks, the local lines being formed of an interconnect layer lower than an Ith (I is an integer equal to or larger than three) layer;

global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and a power supply global line that supplies the power supply voltage from the power supply circuit block, the power supply global line being provided over the data driver block along the first direction.

According to this configuration, since the global line is provided between the nonadjacent circuit blocks, the power supply global line can be provided over the local lines, even if the number of local lines is large, whereby the wiring efficiency can be increased.

According to a further embodiment of the invention, there is provided an electronic instrument comprising one of the above display devices.

According to a further embodiment of the invention, there is provided an electronic instrument comprising: one of the above integrated circuit devices; and the display panel driven by the integrated circuit device.

Preferred embodiments of the invention are described below in detail. Note that the embodiments described below do not in any way limit the scope of the invention defined by the claims laid out herein. Note that all elements of the embodiments described below should not necessarily be taken as essential requirements for the invention.

1. Display Device

FIG. 1 shows an example of a display device (panel module) according to this embodiment. The display device includes an integrated circuit device 10 (display driver) and a display panel 300 on which the integrated circuit device 10 is mounted. The display panel 300 includes an array substrate 310 (array glass substrate) and a common substrate (common glass substrate) (not shown). A TFT array section 312 (display section) in which thin film transistors (TFTs) and pixel electrodes are disposed in a matrix is formed on the array substrate 310, and a common electrode is formed on the common substrate. A liquid crystal element (electro-optical element in a broad sense) is sealed between the array substrate 310 (first substrate in a broad sense) and the common substrate (second substrate in a broad sense).

The integrated circuit device 10 is mounted on the array substrate 310 by chip on glass (COG) technology using bumps (gold bumps or resin core bumps), for example. Specifically, bumps provided on the integrated circuit device 10 and terminals provided on the array substrate 310 are electrically connected through an anisotropic conductive film (ACF). A flexible printed circuit (FPC) substrate 314 is connected with the array substrate 310. Input signal lines and output signal lines of the integrated circuit device 10 are provided on the FPC substrate 314 (flexible substrate). The integrated circuit device 10 and a host processor 330 (main substrate on which the host processor 330 is mounted) are connected through signal lines provided on the FPC substrate 314.

Figure 2:
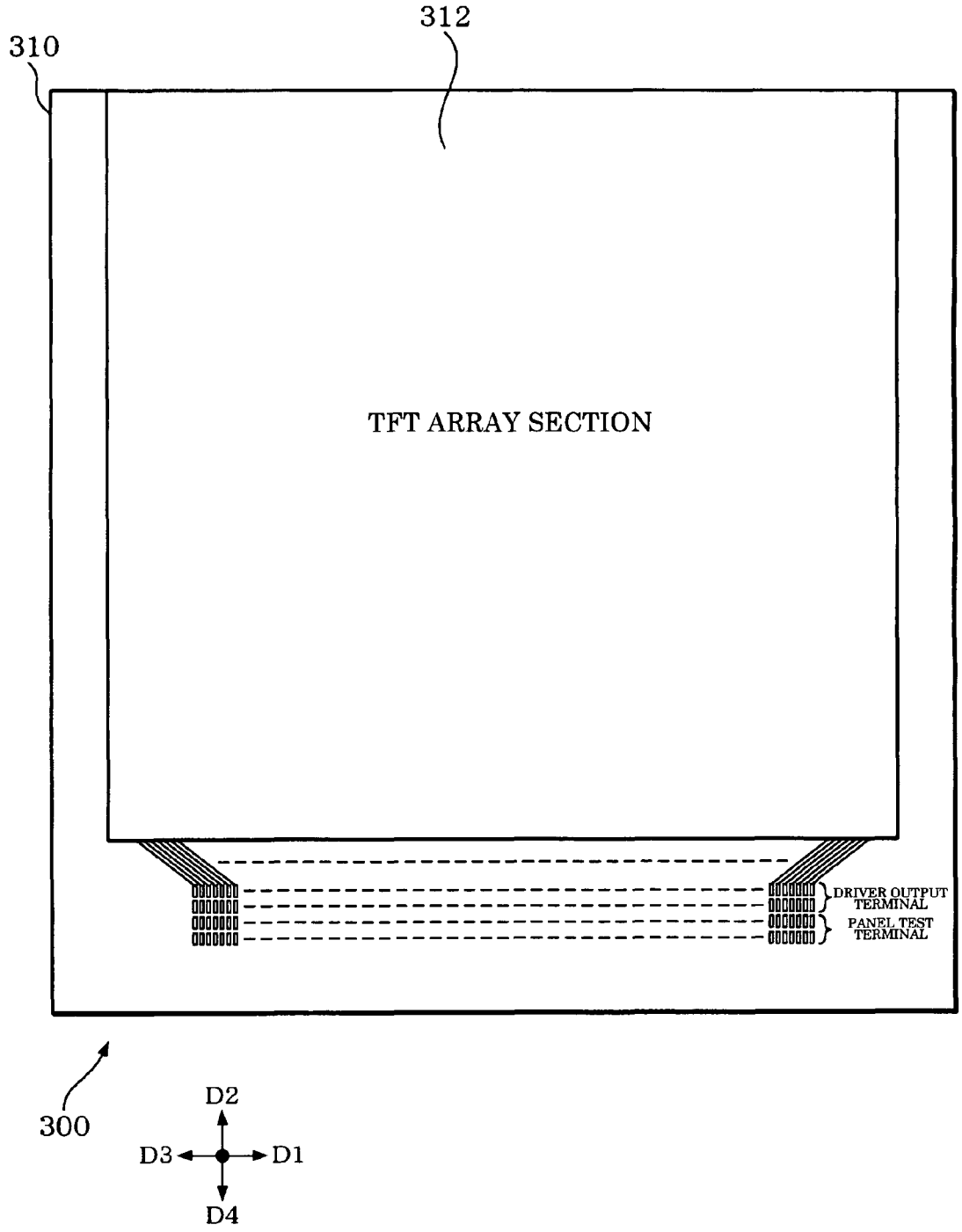
FIG. 2 is a view illustrative of a driver output terminal and a panel test terminal.

As shown in FIG. 2, driver output terminals and panel test terminals are provided on the display panel 300 (array substrate 310).

The panel test terminals are terminal for individually testing the display panel 300. Specifically, before mounting the integrated circuit device 10 on the display panel 300, a test data signal (source signal) and a test scan signal (gate signal) are input to the TFT array section 312 through the panel test terminals. This enables the display panel 300 to be individually tested. Since it is necessary to mount the integrated circuit device on a display panel in which defects have been found, yield can be increased, whereby the cost of the display device can be reduced.

The driver output terminals are electrically connected with data driver pads and the like of the integrated circuit device 10. Specifically, when mounting the integrated circuit device 10 using the COG technology, for example, bumps provided on the active surface of the integrated circuit device 10 are electrically connected with the driver output terminals through an anisotropic conductive film. When the integrated circuit device 10 includes a scan driver, the driver output terminals are electrically connected with scan driver pads of the integrated circuit device 10.

Figure 3:
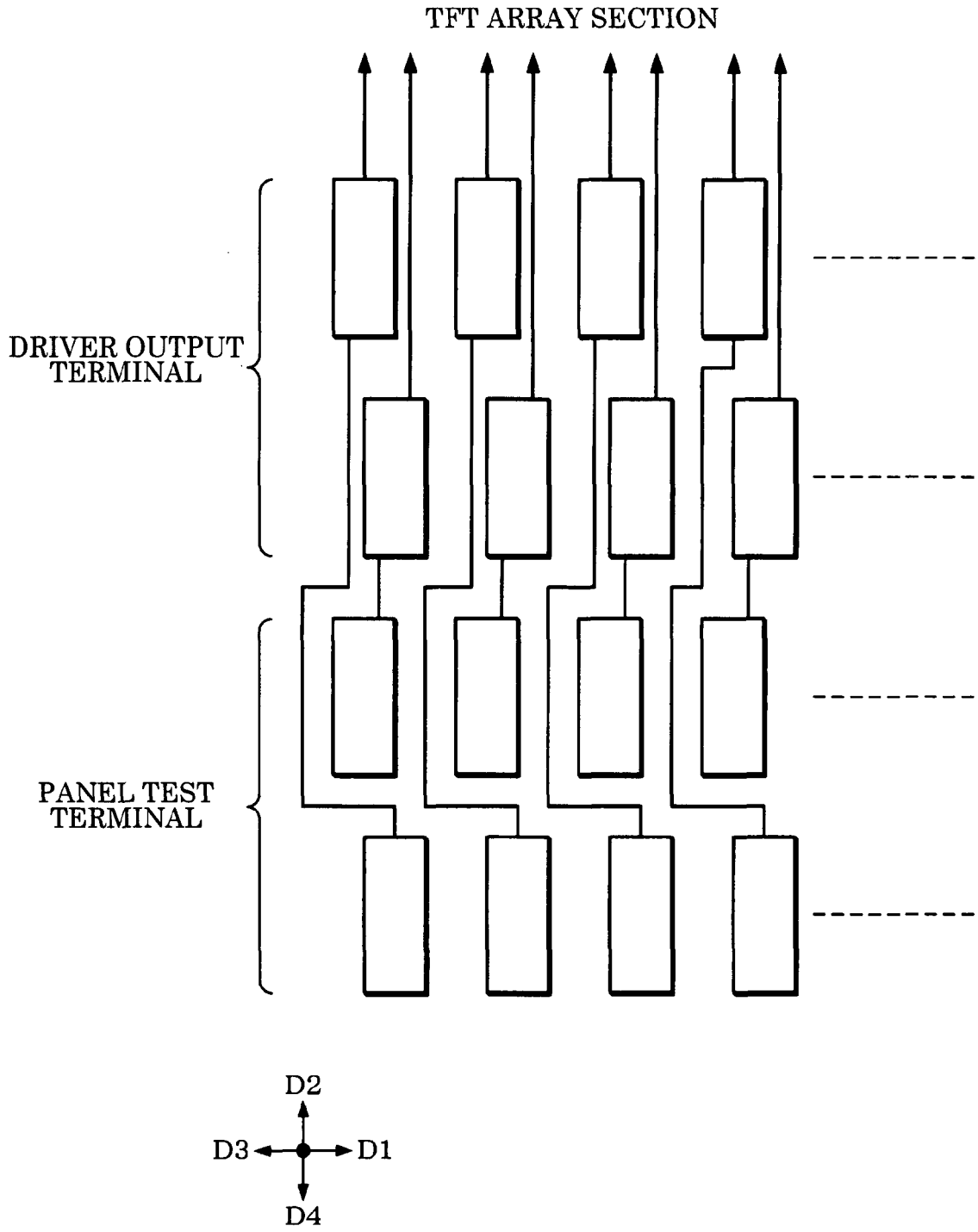
FIG. 3 shows a connection example of a driver output terminal and a panel test terminal.

As shown in FIG. 3, the driver output terminal is electrically connected with the panel test terminal. In FIG. 3, the driver output terminals and the panel test terminals are disposed on the array substrate 310 along a direction D1. The driver output terminals and the panel test terminals are respectively disposed in two rows along the direction D1 and provided in a staggered arrangement. The driver output terminal and the panel test terminal are connected via an interconnect provided along a direction D2.

In order to drive the display panel 300 using the integrated circuit device 10, the driver output terminals are connected with input terminals of the TFT array section 312. This allows a data signal and a scan signal generated by the integrated circuit device 10 to be supplied to data lines and scan lines of the TFT array section 312 through pads (bumps) of the integrated circuit device 10 and the driver output terminals of the display panel. In order to test the display panel 300 through the panel test terminals, the panel test terminals are connected with the input terminals of the TFT array section 312. This allows a test signal from an external tester to be input to the TFT array section 312 through the panel test terminals. As described above, the driver output terminal and the panel test terminal are connected in common with input terminal of the TFT array section 312 and are electrically connected. Note that it suffices that the driver output terminal and the panel test terminal be electrically connected. The connection configuration is not limited to FIG. 3.

Figure 4:
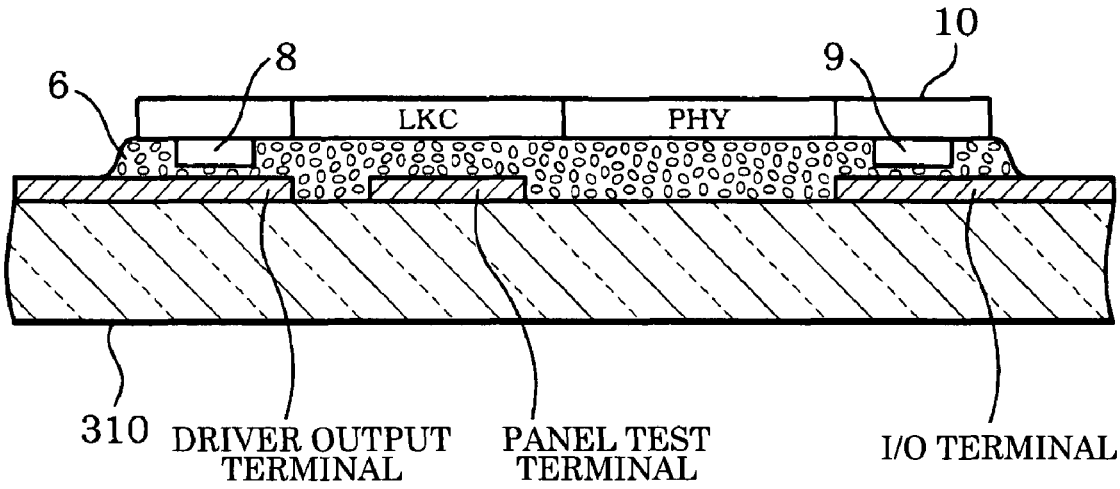
FIG. 4 is a view illustrative of a method of mounting an integrated circuit device on a display panel.

FIG. 4 is a cross-sectional view showing the mounting state of the integrated circuit device 10 on the array substrate 310. Bumps 8 and 9 are formed on the active surface of the integrated circuit device 10 (IC chip). The bumps 8 and 9 are electrically connected with the data driver pad (scan driver pad) and an IO pad of the integrated circuit device 10, respectively. The bump 8 is electrically connected with the driver output terminal of the display panel through an anisotropic conductive film (ACF), and the bump 9 is electrically connected with an I/O terminal of the display panel through the anisotropic conductive film. The I/O terminal is connected with an interconnect of the FPC substrate 314 shown in FIG. 1, for example.

In this embodiment, the panel test terminal is not located under a physical layer circuit PHY, but is located under a link controller LKC, as shown in FIG. 4.

2. Integrated Circuit Device

In recent years, a high-speed I/F circuit (high-speed interface circuit) which serially transfers data using differential signals has attracted attention. In the high-speed I/F circuit, since the amplitude of the differential signals is small, the differential signals tend to be affected by external noise, whereby a transfer error may occur. Therefore, it is desirable to minimize the effect of external noise on the differential signals. On the other hand, in order to prevent a decrease in yield, it is desirable to provide the panel test terminals described with reference to FIGS. 1 to 4 on the display panel.

However, the panel test terminal is connected with the driver output terminal, as shown in FIG. 3. Therefore, when mounting the integrated circuit device and driving the display panel, a change in the voltage level of a driving signal (data signal and scan signal) appears not only at the driver output terminal but also at the panel test terminal. A change in the voltage level of the panel test terminal may adversely affect the high-speed I/F circuit.

Figure 5:
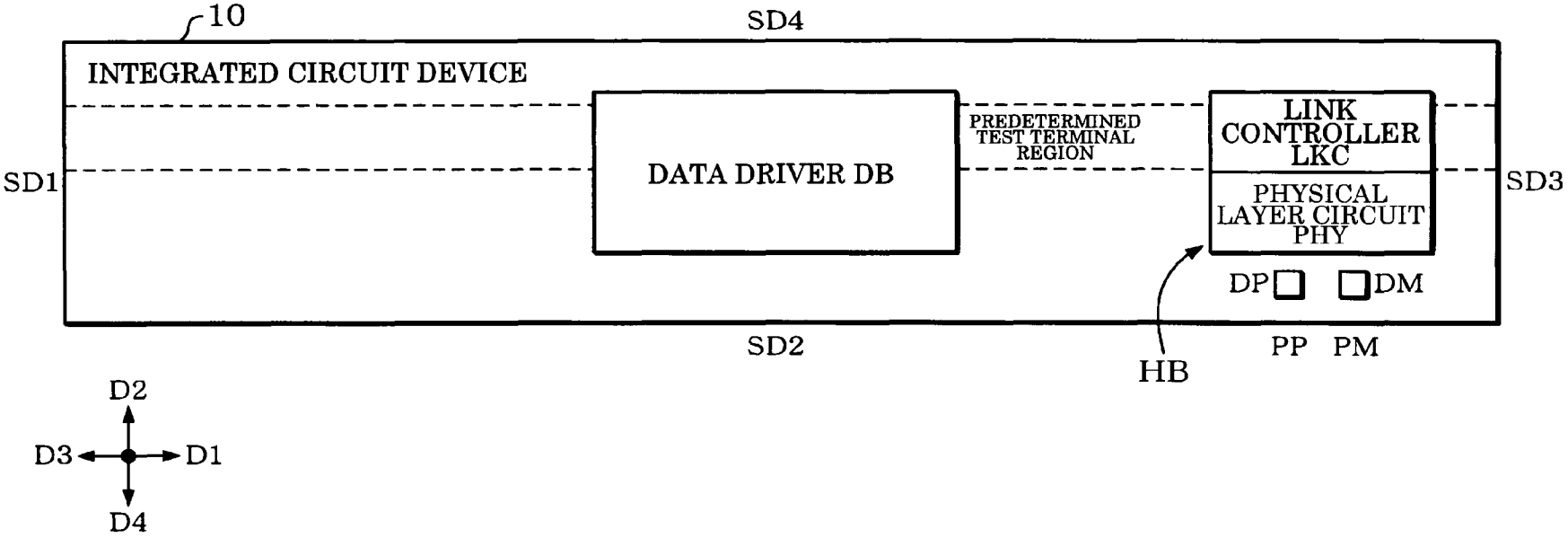
FIG. 5 shows an arrangement configuration example of an integrated circuit device using an arrangement method according to one embodiment of the invention.

In order to deal with this problem, this embodiment employs the following method. In FIG. 5, the integrated circuit device 10 includes at least one data driver block DB and a high-speed I/F circuit block HB, for example. In this embodiment, the direction from a first side SD1 (short side) of the integrated circuit device 10 toward a third side SD3 opposite to the first side SD1 is referred to as a first direction D1, and the direction opposite to the first direction D1 is referred to as a third direction D3. The direction from a second side SD2 (long side) of the integrated circuit device 10 toward a fourth side SD4 opposite to the second side SD2 is referred to as a second direction D2, and the direction opposite to the second direction D2 is referred to as a fourth direction D4. In FIG. 5, the left side of the integrated circuit device 10 is the first side SD1, and the right side is the third side SD3. Note that the left side may be the third side SD3, and the right side may be the first side SD1.

The data driver block DB is a circuit which drives the data lines of the display panel. In this case, two or more data driver blocks may be provided along the direction D1, for example. A memory block may be provided which is disposed adjacent to the data driver block DB in the direction D1 and stores image data used in the data driver block DB. Or, the memory block may be disposed adjacent to the data driver block DB in the direction D4.

The high-speed I/F circuit block HB includes a physical layer circuit PHY, and transfers data through a serial bus using differential signals. The physical layer circuit PHY is a circuit which performs a physical layer process. Specifically, the physical layer circuit PHY may include a receiver circuit to which first and second signals DP and DM forming small-amplitude differential signals are input. The signals DP and DM are input through differential input pads PP and PM provided in the direction D4 with respect to the physical layer circuit PHY. The physical layer circuit PHY may include a serial/parallel conversion circuit which converts serial data received through the serial bus into parallel data. The physical layer circuit PHY may include a transmitter circuit which transmits data using differential signals, and a parallel/serial conversion circuit which converts parallel data into serial data.

The high-speed I/F circuit block HB may include a link controller LKC. The link controller LKC performs a link layer process. Specifically, the link controller LKC analyzes a packet received using differential signals, for example. Or, the link controller LKC may generate a packet transmitted using differential signals. The link controller LKC is disposed in the direction D2 with respect to the physical layer circuit PHY, for example.

In FIG. 5, a region in which the panel test terminals are positioned under the integrated circuit device 10 when the integrated circuit device 10 is mounted on the display panel is shown as a predetermined test terminal region. The term "under" according to this embodiment may be defined as a direction from the integrated circuit device 10 toward the array substrate 310 (first substrate on which the integrated circuit device is mounted) in FIG. 4, for example. The term "over" may be defined as a direction from the array substrate 310 toward the integrated circuit device 10.

The predetermined test terminal region shown in FIG. 5 is a rectangular region having a long side along the direction D1 and a short side along the direction D2, for example. In this embodiment, the physical layer circuit PHY is disposed in a region which does not overlap the predetermined test terminal region. Specifically, the physical layer circuit PHY is disposed in the direction D4 with respect to the predetermined test terminal region. Specifically, the physical layer circuit PHY is disposed between the predetermined test terminal region and the differential input pads PP and PM.

In FIG. 5, the link controller LKC is disposed in a region which overlaps the predetermined test terminal region. Specifically, the panel test terminals of the display panel are disposed under the link controller LKC in plan view.

The arrangement positions of the physical layer circuit PHY and the link controller LKC are not limited to FIG. 5. Various modifications may be made. For example, the physical layer circuit PHY and the link controller LKC are adjacently disposed along the direction D2 in FIG. 5. Note that the physical layer circuit PHY and the link controller LKC may not be adjacently disposed. For example, the link controller LKC may be disposed in the direction D1 or the direction D3 with respect to the physical layer circuit PHY.

Figure 6A:
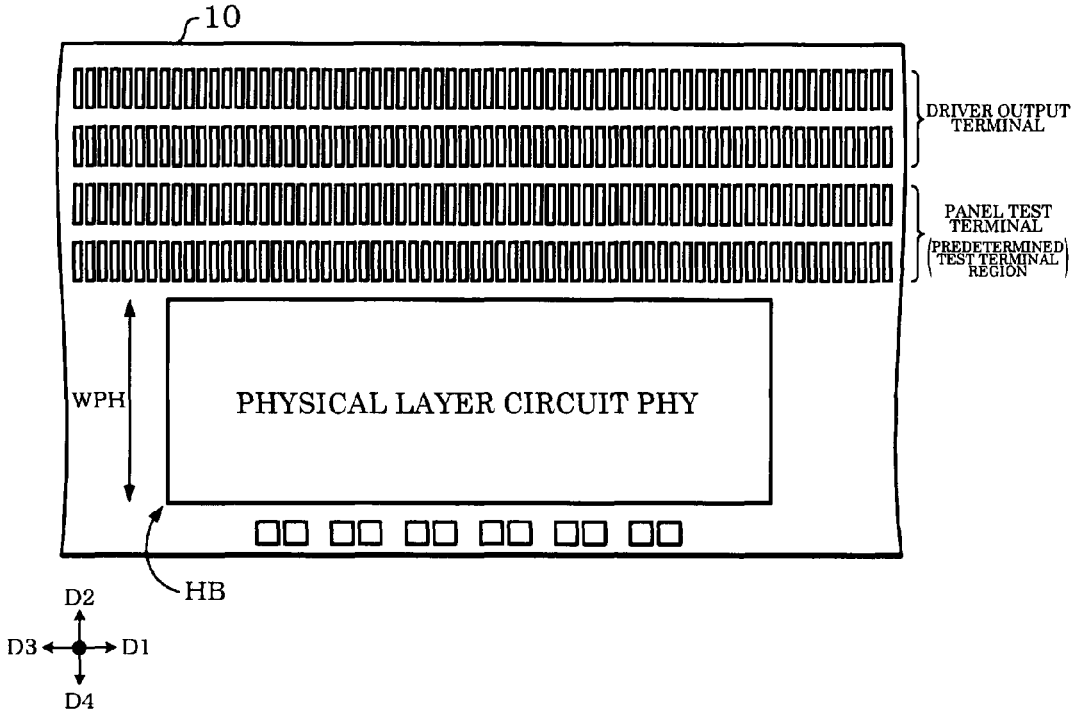
FIGS. 6A and 6B show a detailed arrangement example of a physical layer circuit.
Figure 6B:
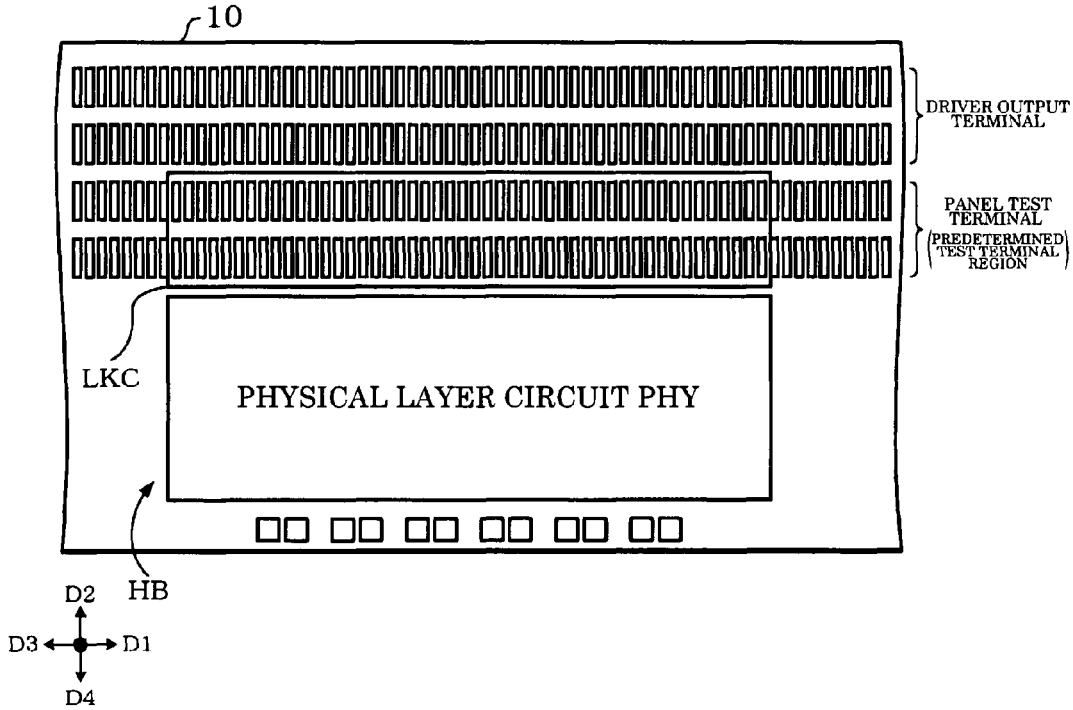

FIGS. 6A and 6B show a detailed arrangement example of the physical layer circuit. In FIG. 6A, the driver output terminals and the panel test terminals of the display panel are disposed under the integrated circuit device 10 along the direction D1. The driver output terminals and the panel test terminals are terminals in two rows provided along the direction D1, as described with reference to FIG. 3. The driver output terminal is electrically connected with the data driver pad (scan driver pad) through the bump and the anisotropic conductive film, as described with reference to FIG. 4. The data driver pad (scan driver pad) is connected with an output line of the data driver block DB (scan driver block) shown in FIG. 5.

As shown in FIG. 6A, the driver output terminals are disposed in the direction D2 with respect to the panel test terminal in plan view, and the panel test terminals are disposed in the direction D2 with respect to the physical layer circuit PHY. Specifically, the physical layer circuit PHY is disposed in a region which does not overlap the test terminal region (panel test terminals) in plan view.

Figure 7:
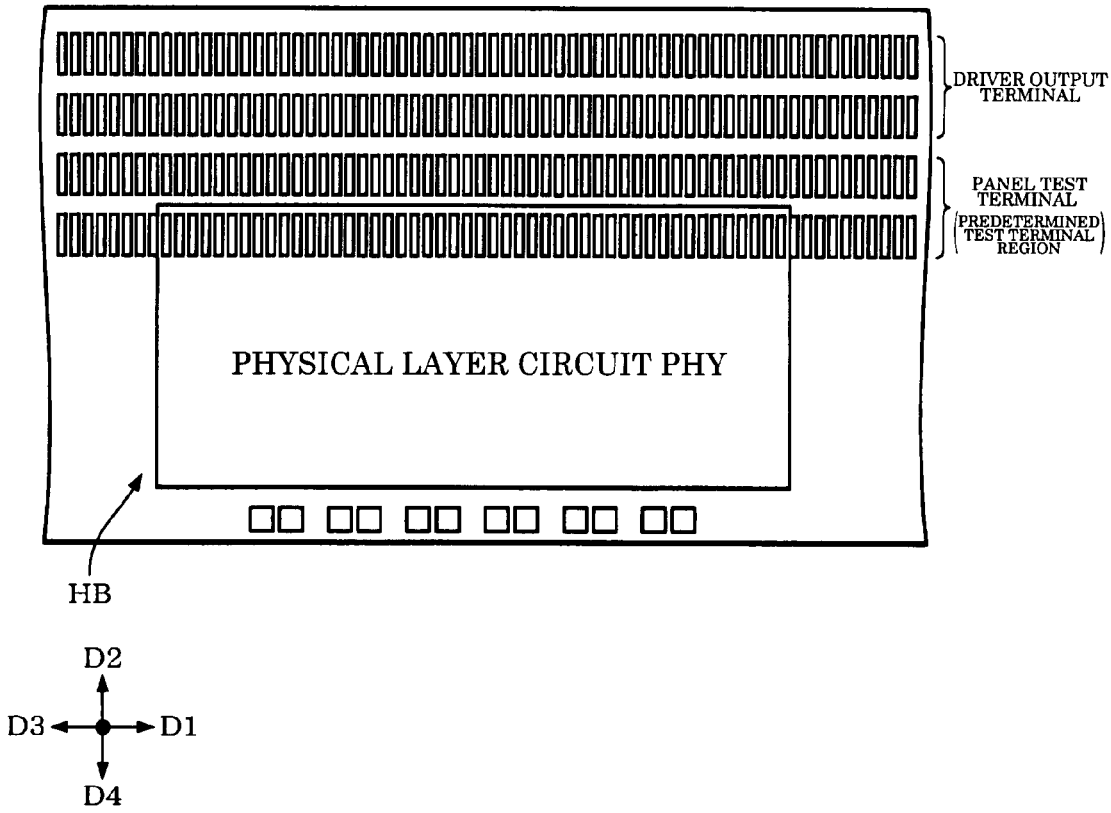
FIG. 7 shows an arrangement example according to a comparative example.

FIG. 7 shows a comparative example of this embodiment. In FIG. 7, the physical layer circuit PHY overlaps the predetermined test terminal region in plan view. Since the driver output terminal and the panel test terminal are connected, as shown in FIG. 3, when the voltage level of the driver output terminal changes when driven by the data driver block DB, the voltage level of the panel test terminal also changes. Therefore, a change in the voltage level of the panel test terminal (signal noise) may adversely affect the physical layer circuit PHY located over the panel test terminals, whereby a malfunction such as a transfer error may occur.

Specifically, the comparative example shown in FIG. 7 does not expect and take into account such signal noise from the panel test terminal. However, a change in the voltage level of the driver output terminal is about 5 to 20 V, for example. Such a change in voltage level also occurs at the panel test terminal connected with the driver output terminal. The panel test terminals are disposed in the direction D4 with respect to the driver output terminals, and are disposed at a position close to the physical layer circuit PHY. Since the amplitude of the differential signals handled by the physical layer circuit PHY is about 0.1 to 1.0 V, for example, a change in the voltage level of the panel test terminal (5 to 20 V) cannot be disregarded.

In this embodiment shown in FIG. 6A, the physical layer circuit PHY is disposed so that the physical layer circuit PHY does not overlap the predetermined test terminal region. Specifically, the physical layer circuit PHY is disposed while reducing the width WPH of the physical layer circuit PHY in the direction D2 so that the physical layer circuit PHY is positioned between the predetermined test terminal region and the arrangement region of the differential input pads. This makes it possible to increase the distance between the panel test terminals and the physical layer circuit PHY as compared with the comparative example shown in FIG. 7. This effectively prevents a situation in which signal noise from the panel test terminal adversely affects the physical layer circuit PHY, whereby a malfunction such as a transfer error occurs.

In FIG. 6B, the link controller LKC is disposed in a region which overlaps the predetermined test terminal region. Specifically, the predetermined test terminal region partially overlaps the link controller LKC in plan view. The link controller LKC is disposed in the direction D2 with respect to the physical layer circuit PHY, and the driver output terminals are disposed in the direction D2 with respect to the panel test terminals. Specifically, the link controller LKC is disposed to overlap the predetermined test terminal region which is the region between the driver output terminals and the physical layer circuit PHY.

The amplitude of a signal handled by the link controller LKC is larger than the amplitude of the differential signals. While the differential signals are analog signals, the signal handled by the link controller LKC is a digital signal. Therefore, the extent of an adverse effect of signal noise from the panel test terminal on the link controller LKC is small as compared with the physical layer circuit PHY. Therefore, a serious problem does not occur, even if the link controller LKC is disposed to overlap the predetermined test terminal region, as shown in FIG. 6B.

On the other hand, the physical layer circuit PHY and the link controller LKC can be connected through a signal line along a short path by disposing the link controller LKC in the direction D2 with respect to the physical layer circuit PHY while allowing the link controller LKC to overlap the predetermined test terminal region, whereby the layout efficiency can be increased. In particular, since the operating frequency of the signal line between the physical layer circuit PHY and the link controller LKC is high, a signal transfer error can be prevented by providing the signal line along a short path.

As described above, a malfunction due to signal noise from the panel test terminal can be prevented while increasing the layout efficiency by allowing the link controller LKC to overlap the predetermined test terminal region while preventing the physical layer circuit PHY from overlapping the predetermined test terminal region.

3. Common Voltage Line

Figure 8A:
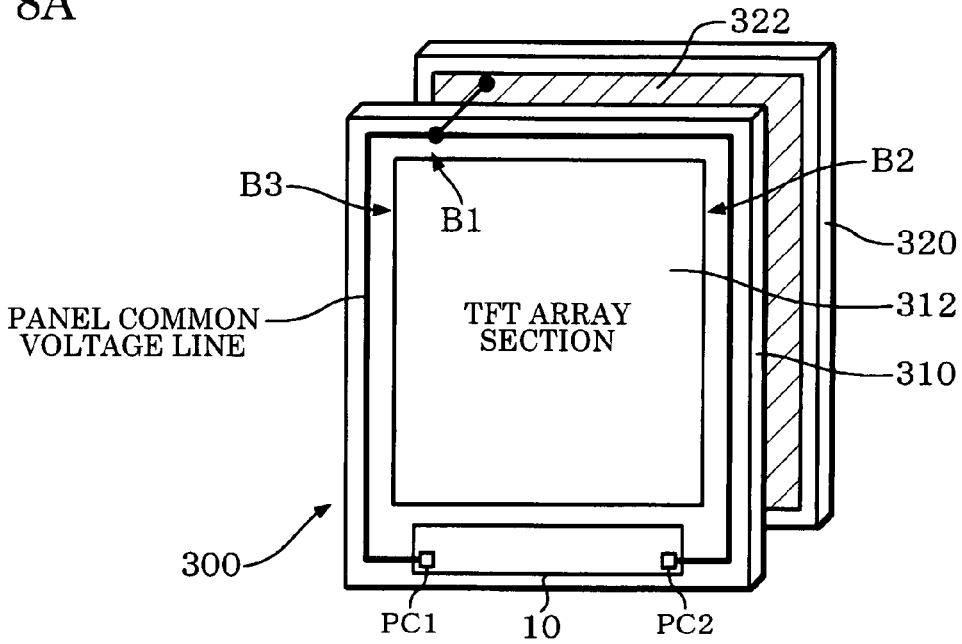
FIGS. 8A to 8C are views illustrative of a display panel.
Figure 8B:
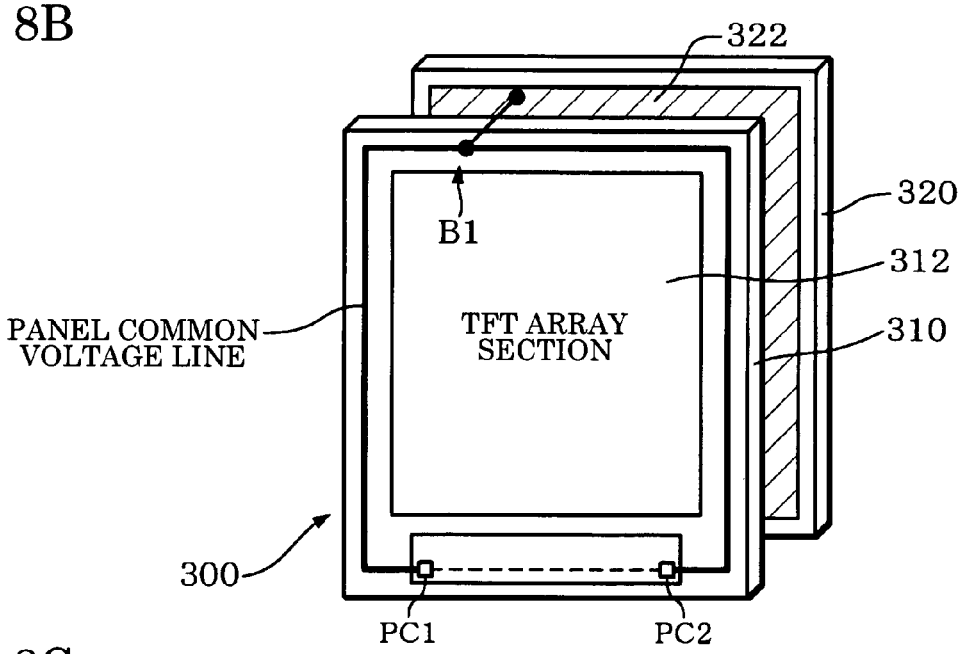

In FIGS. 8A and 8B, the display panel 300 includes the array substrate 310 and the common substrate 320, and a common electrode 322 is formed on the common substrate 320.

In FIGS. 8A and 8B, a panel common voltage line (common voltage line) which supplies a common voltage (common electrode voltage) is provided along the periphery of the TFT array section 312 of the array substrate 310. Specifically, the panel common voltage line is provided from a common voltage pad PC1 provided on the left end of the integrated circuit device 10 (IC) along the left edge, the upper edge, and the right edge of the array substrate 310, and is connected to a common voltage pad PC2 provided on the right end of the integrated circuit device 10. The panel common voltage line is electrically connected with the common electrode 322 of the common substrate 320 at an arbitrary position, such as a position indicated by B1. This enables the common voltage to be supplied to the common electrode 322.

In FIG. 8A, the panel common voltage line is not provided under the integrated circuit device 10. In FIG. 8B, the panel common voltage line is provided under the integrated circuit device 10.

Figure 8C:
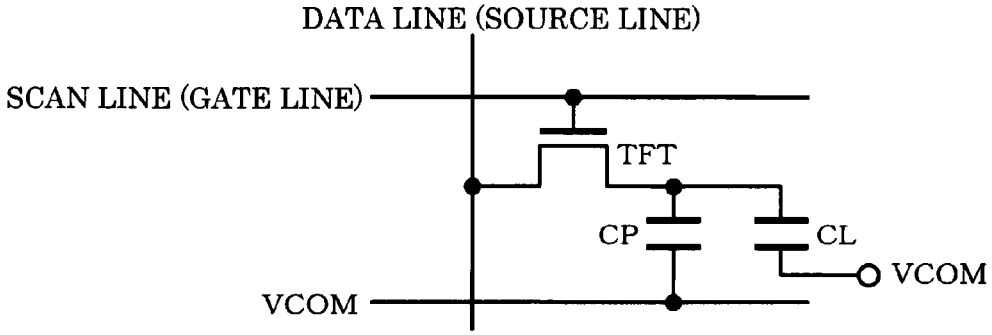

As shown in FIG. 8C, a data line (source line) is connected with the source of a TFT (thin film transistor), and a scan line (gate line) is connected with the gate of the TFT. The integrated circuit device 10 supplies a data signal and a scan signal to the data line and the scan line, respectively. One end of a liquid crystal capacitor CL formed of a liquid crystal element is connected with the drain of the TFT, and a common voltage is supplied to the other end of the liquid crystal capacitor CL. One end of a storage capacitor CP is connected with the drain of the TFT, the common voltage is supplied to the other end of the storage capacitor CP. When using such a storage capacitor CP, the panel common voltage line is also provided in the TFT array section 312 shown in FIGS. 8A and 8B.

The voltage difference between the grayscale voltage and the common voltage VCOM is applied to the liquid crystal element. Therefore, when the common voltage VCOM generated by the display driver does not reach the desired voltage due to parasitic resistance and the like, the voltage applied to the liquid crystal element does not reach the desired voltage, whereby the display quality deteriorates. In order to prevent such deterioration in display quality, it is important to reduce the parasitic resistance of the common voltage line as much as possible.

4. Common Voltage Line of Integrated Circuit Device

The high-speed I/F circuit is easily affected by external noise, as described above. On the other hand, the display quality of the display panel deteriorates when the parasitic resistance of the common voltage line increases. Therefore, it is desirable to employ a layout method described below.

Figure 9A:
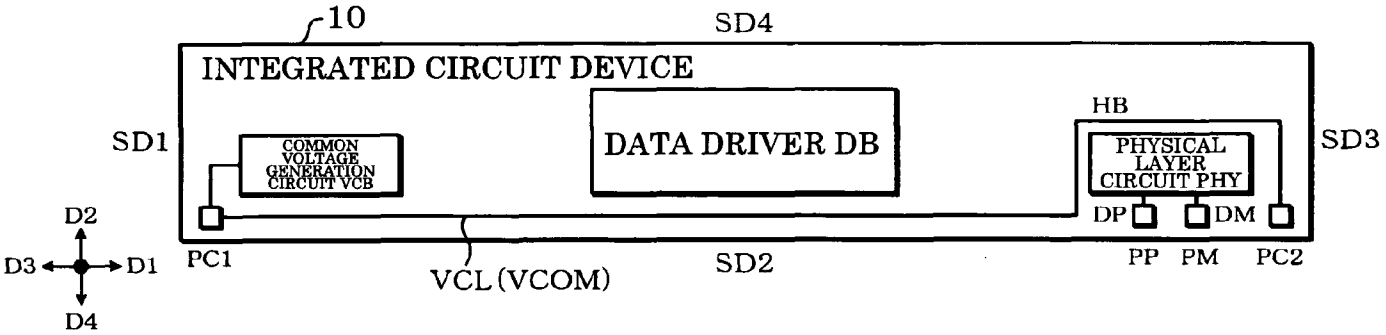
FIGS. 9A to 9C are views illustrative of a common voltage line wiring method.

In FIG. 9A, the integrated circuit device 10 includes a common voltage generation circuit VCB, at least one data driver block DB, and the physical layer circuit PHY forming the high-speed I/F circuit block HB, for example.

The common voltage generation circuit VCB generates the common voltage VCOM applied to the common electrode of the display panel. Specifically, the common voltage generation circuit VCB generates the common voltage VCOM of which the polarity is reversed in units of scan periods, for example.

In FIG. 9A, the first and second common voltage pads PC1 and PC2 are provided. The common voltage pad PC1 is disposed in the direction D3 with respect to the data driver block DB, and the common voltage pad PC2 is disposed in the direction D1 with respect to the data driver block DB. Specifically, the common voltage pad PC1 is disposed on the left end of the integrated circuit device 10, and the common voltage pad PC2 is disposed on the right end of the integrated circuit device 10.

First and second differential input pads PP and PM for externally inputting first and second signals DP and DM forming differential signals are disposed in the direction D4 (host side) with respect to the physical layer circuit PHY. A common voltage line VCL (in-chip common voltage line) which connects the common voltage pads PC1 and PC2 is provided from the common voltage pad PC1 to the common voltage pad PC2 along the direction D1. Specifically, the common voltage line VCL is provided in the direction D2 with respect to the physical layer circuit PHY along the direction D1 in the arrangement region of the physical layer circuit PHY. That is, the common voltage line VCL provided from the common voltage pad PC1 in the direction D1 turns along the direction D2 to run around the physical layer circuit PHY so as to avoid the physical layer circuit PHY. The common voltage line VCL is thus provided in the direction D2 with respect to the physical layer circuit PHY along the direction D1, continues in the direction D1, and then turns along the direction D4. The common voltage line VCL is then connected to the common voltage pad PC2.

In FIG. 9A, the common voltage line VCL is provided in the direction D4 with respect to the data driver block DB along the direction D1 in the arrangement region of the data driver block DB. Specifically, the common voltage line VCL is provided along the direction D1 between the host-side side SD2 of the integrated circuit device 10 and the data driver block DB.

Figure 9B:
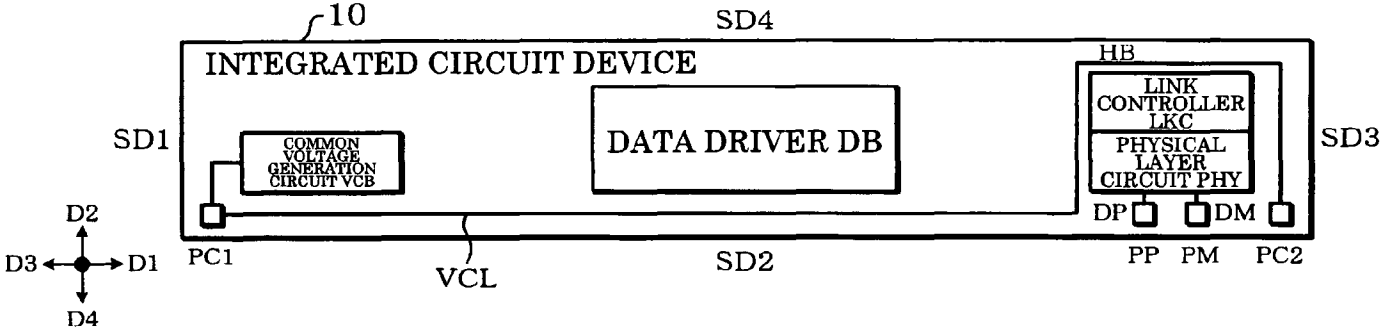

In FIG. 9B, the common voltage line VCL is provided in the direction D2 with respect to the link controller LKC along the direction D1. Specifically, the common voltage line VCL runs along the direction D2 in the direction D3 with respect to the physical layer circuit PHY and the link controller LKC. The common voltage line VCL then turns along the direction D1 in the direction D2 with respect to the link controller LKC, returns along the direction D4 in the direction D1 with respect to the physical layer circuit PHY and the link controller LKC, and is connected to the common voltage pad PC2.

Figure 9C:
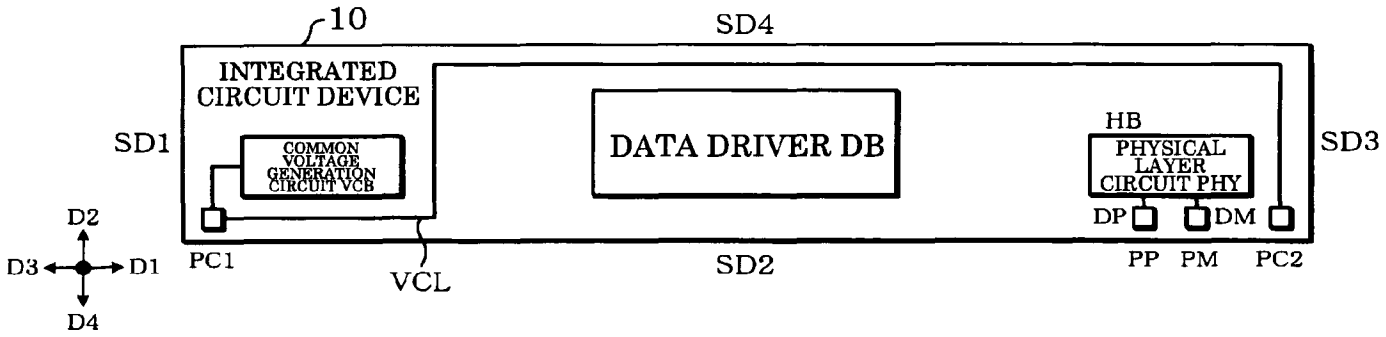

The common voltage generation circuit VCB is disposed in the direction D3 with respect to the data driver block DB. The common voltage generation circuit VCB may be disposed in the direction D1 with respect to the data driver block DB. As shown in FIG. 9C, a modification may be made in which the common voltage line VCL is provided in the direction D2 with respect to the data driver block DB along the direction D1 in the arrangement region of the data driver block DB.

In this embodiment, the common voltage line VCL connects the common voltage pads PC1 and PC2 in the chip of the integrated circuit device 10, as shown in FIGS. 9A to 9C.

For example, if the common voltage pads PC1 and PC2 are not electrically connected in the chip of the integrated circuit device 10 in FIG. 8A, the parasitic resistance of the panel common voltage line at a position indicated by B2 becomes higher than the parasitic resistance of the panel common voltage line at a position indicated by B3. Therefore, the period of time until the common voltage reaches the desired voltage becomes imbalanced due to the imbalanced parasitic resistance, whereby the display quality deteriorates.

According to this embodiment, since the common voltage pads PC1 and PC2 are electrically connected through the common voltage line VCL, the parasitic resistance of the common voltage line at a position indicated by B2 in FIG. 8A can be made almost equal to the parasitic resistance of the common voltage line at a position indicated by B3. Therefore, deterioration in display quality due to the imbalanced parasitic resistance can be reduced. Specifically, even if the panel common voltage line is not provided under the integrated circuit device 10, as shown in FIG. 8A, the common voltage line is provided in the shape of a ring in the peripheral portion of the array substrate 310 in the same manner as in FIG. 8B using the common voltage line VCL provided in the integrated circuit device 10. Therefore, the parasitic resistance can be made equal at each position of the common voltage line. In particular, when providing the panel common voltage line in the TFT array section 312 for the storage capacitor CP, as shown in FIG. 8C, display unevenness or the like may occur if the parasitic resistance of the common voltage line becomes imbalanced. According to this embodiment, occurrence of display unevenness or the like can be prevented by connecting the common voltage pads PC1 and PC2 in the integrated circuit device 10 using the common voltage line VCL.

In this embodiment, the common voltage line VCL is provided to avoid the differential signal lines which connect the physical layer circuit PHY and the differential input pads PP and PM. This prevents a situation in which noise from the common voltage line VCL, of which the voltage changes in units of horizontal scan periods, is superimposed on the input signals DP and the DM of the physical layer circuit PHY, for example. Specifically, if the common voltage line VCL provided from the common voltage pad PC1 along the direction D1 is linearly provided along the direction D1 in the region of the physical layer circuit PHY, the common voltage line VCL intersects the differential signal lines from the differential input pads PP and PM. As a result, noise from the common voltage line VCL is superimposed on the differential signals DP and DM through parasitic capacitors and the like, whereby a data transfer error or the like may occur.

According to this embodiment, since the common voltage line VCL is provided to avoid intersection with the signals DP and DM, such a problem can be prevented.

In FIGS. 9A and 9B, the common voltage line VCL is provided in the direction D4 with respect to the data driver block DB along the direction D1. Therefore, a large number of data signal lines from the data driver block DB do not intersect the common voltage line VCL. This prevents a situation in which noise from a large number of data signal lines is superimposed on the common voltage line VCL through parasitic capacitors. As a result, a situation in which the display quality deteriorates due to a change in the level of the common voltage VCOM can be prevented.

The signal lines which operate at a high speed are provided between the physical layer circuit PHY and the link controller LKC. Therefore, if the common voltage line VCL is provided between the physical layer circuit PHY and the link controller LKC, noise from the high-speed signal lines may be transmitted to the common voltage line VCL, whereby the display quality may deteriorate.

In FIG. 9B, the common voltage line VCL is not provided between the physical layer circuit PHY and the link controller LKC, but is provided in the direction D2 with respect to the link controller LKC. This prevents a situation in which noise from the high-speed signal lines provided between physical layer circuit PHY and the link controller LKC is transmitted to the common voltage line VCL or noise from the common voltage line VCL is transmitted to the high-speed signal lines, whereby the display quality can be increased.

5. Detailed Layout of Integrated Circuit Device

Figure 10:
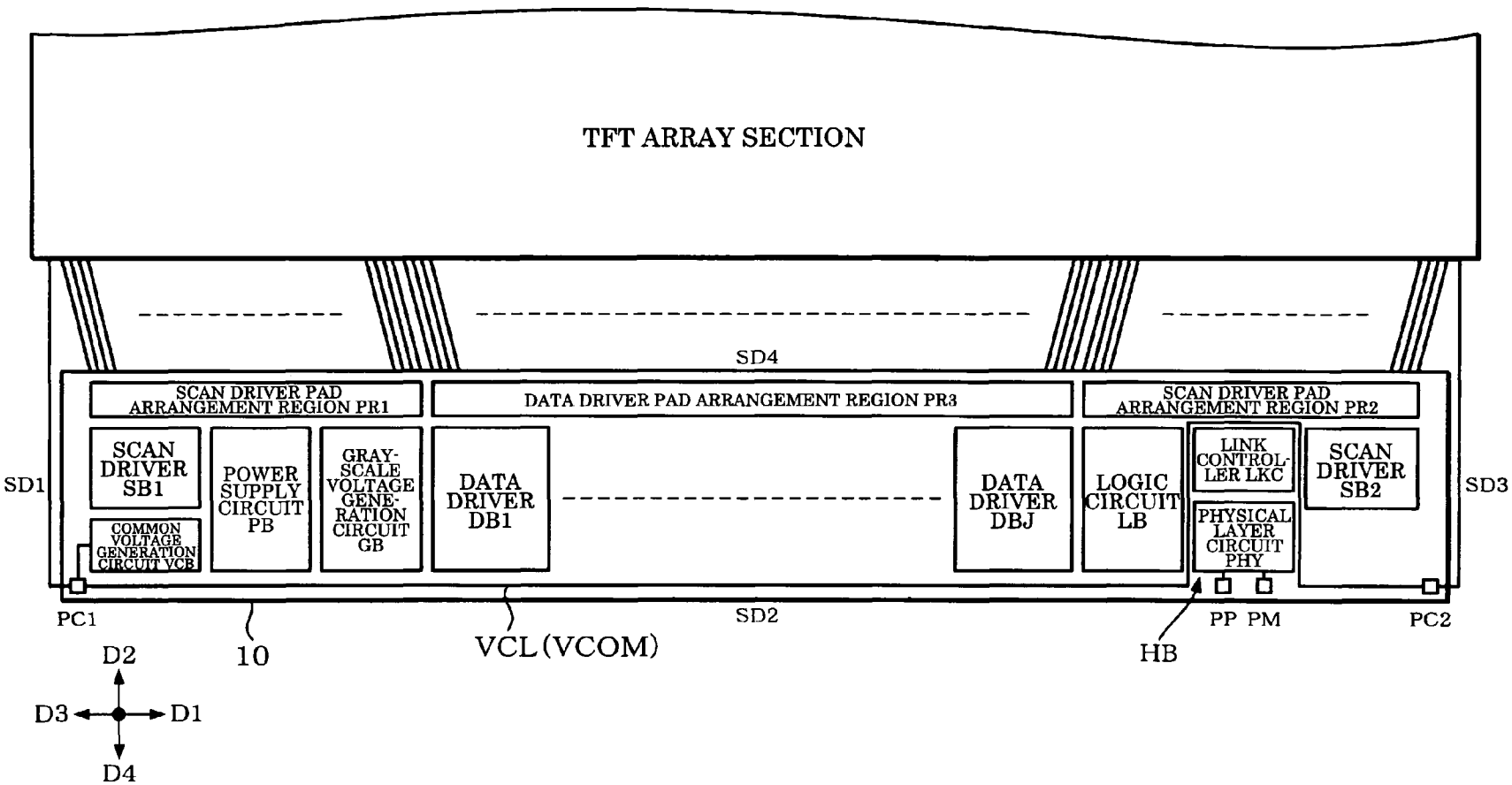
FIG. 10 shows a detailed layout example of an integrated circuit device.

FIG. 10 shows a detailed layout example of the integrated circuit device 10. The integrated circuit device 10 shown in FIG. 10 includes data driver blocks DB1 to DBJ which are disposed along the direction D1 and drive the data lines, and first and second scan driver blocks SB1 and SB2 which drive the scan lines. The integrated circuit device 10 also includes a grayscale voltage generation circuit block GB which generates grayscale voltages, a power supply circuit block PB which generates a power supply voltage, the high-speed I/F circuit block HB including the physical layer circuit PHY and the link controller LKC, the logic circuit block LB, and the common voltage generation circuit VCB.

The logic circuit block LB receives data received by the high-speed I/F circuit block HB. The logic circuit block LB transfers grayscale adjustment data for adjusting the grayscale voltage to the grayscale voltage generation circuit block GB, and transfers power supply adjustment data for adjusting the power supply voltage to the power supply circuit block PB.

In FIG. 10, the grayscale voltage generation circuit block GB is disposed in the direction D3 with respect to the data driver blocks DB1 to DBJ. Specifically, grayscale voltage generation circuit block GB is disposed in the direction D3 with respect to the leftmost data driver block DB1. Likewise, the power supply circuit block PB is disposed in the direction D3 with respect to the data driver blocks DB1 to DBJ. Specifically, the power supply circuit block PB is disposed in the direction D3 with respect to the leftmost data driver block DB1. The high-speed I/F circuit block HB and the logic circuit block LB are disposed in the direction D1 with respect to the data driver blocks DB1 to DBJ. Specifically, the high-speed I/F circuit block HB and the logic circuit block LB are disposed in the direction D1 with respect to the rightmost data driver block DBJ.

The grayscale voltage generation circuit block GB is disposed between the first scan driver block SB1 and the data driver blocks DB1 to DBJ. The high-speed I/F circuit block HB is disposed between the second scan driver block SB2 and the data driver blocks DB1 to DBJ. The common voltage generation circuit VCB is disposed in the direction D4 with respect to the scan driver block SB1.

In FIG. 10, local lines formed of a lower interconnect layer are provided between the adjacent circuit blocks. Global lines formed of an interconnect layer positioned in an upper layer of the local lines are provided between the nonadjacent circuit blocks along the direction D1. A grayscale global line for supplying the grayscale voltage from the grayscale voltage generation circuit block GB to the data driver blocks DB1 to DBJ and a power supply global line for supplying the power supply voltage from the power supply circuit block PB are provided over the data driver blocks DB1 to DBJ along the direction D1.

When disposing the scan driver blocks SB1 and SB2 on either end of the integrated circuit device 10, as shown in FIG. 10, it is desirable to dispose the scan driver pads, through which the scan signals are output, on each end of the integrated circuit device 10 taking the wiring efficiency into consideration. On the other hand, the data driver blocks DB1 to DBJ are disposed around the center of the integrated circuit device 10. Therefore, it is desirable to dispose the data driver pads, through which the data signals are output, around the center of the integrated circuit device 10 taking the wiring efficiency into consideration.

In FIG. 10, scan driver pad arrangement regions PR1 and PR2 are provided on either end of the integrated circuit device 10, and a data driver pad arrangement region PR3 is provided between the scan driver pad arrangement regions PR1 and PR2. This ensures that the output lines of the scan driver blocks SB1 and SB2 and the output lines of the data driver blocks DB1 to DBJ can be efficiently connected with the pads in the scan driver pad arrangement regions PR1 and PR2 and the pads in the data driver pad arrangement region PR3.

In FIG. 10, the data driver blocks DB1 to DBJ are disposed around the center of the integrated circuit device 10. Therefore, the data driver pad arrangement region PR3 can be provided in the free space in the direction D2 with respect to the data driver blocks DB1 to DBJ, whereby the free space can be effectively utilized. Note that the data signal lines on the panel connected with the pads in the data driver pad arrangement region PR3 are provided in the TFT array section on the array substrate.

In FIG. 10, the grayscale voltage generation circuit block GB and the power supply circuit block PB with a large circuit area are disposed in the direction D3 with respect to the data driver blocks DB1 to DBJ. The logic circuit block LB and the high-speed I/F circuit block HB with a large circuit area are disposed in the direction D1 with respect to the data driver blocks DB1 to DBJ. According to this configuration, the scan driver pad arrangement regions PR1 and PR2 can be provided utilizing the free space formed in the direction D2 with respect to the grayscale voltage generation circuit block GB and the power supply circuit block PB with a large circuit area and the free space formed in the direction D2 with respect to the logic circuit block LB and the high-speed I/F circuit block HB. Therefore, the wiring efficiency can be increased by effectively utilizing the free space, whereby the width of the integrated circuit device 10 in the direction D2 can be reduced. Note that the scan signal lines on the panel connected with the pads in the scan driver pad arrangement regions PR1 and PR2 are provided in the TFT array section on the array substrate. The panel common voltage line is provided on the left and right of the scan signal lines.

In FIG. 10, the logic circuit block LB and the high-speed I/F circuit block HB are adjacently disposed along the direction D1. Therefore, the signal line of data received by the high-speed I/F circuit block HB can be connected with the logic circuit block LB along a short path, whereby the layout efficiency can be increased. A modification may be made in which the high-speed I/F circuit block HB (physical layer circuit) is disposed in the direction D4 with respect to the logic circuit block LB, for example.

In FIG. 10, the high-speed I/F circuit block HB is disposed in the direction D1 with respect to the data driver blocks DB1 to DBJ (i.e., the high-speed I/F circuit block HB is not disposed in the arrangement region of the data driver blocks DB1 to DBJ). Therefore, the grayscale global line and the power supply global line provided over the data driver blocks DB1 to DBJ need not pass over the high-speed I/F circuit block HB. Therefore, the high-speed I/F circuit block HB (physical layer circuit PHY) can be prevented from being adversely affected by noise from these global lines, whereby a malfunction of the high-speed I/F circuit block HB and the like can be prevented.

For example, when mounting the integrated circuit device 10 on a glass substrate (array substrate) using bumps by means of COG technology, the contact resistance of the bumps increases on each end of the integrated circuit device 10. Specifically, since the coefficient of thermal expansion differs between the integrated circuit device 10 and the glass substrate, stress (thermal stress) caused by the difference in coefficient of thermal expansion becomes greater on each end of the integrated circuit device 10 than at the center of the integrated circuit device 10. As a result, the contact resistance of the bumps increases with time on each end of the integrated circuit device 10. In particular, the narrower the integrated circuit device 10, the larger the difference in stress between each end and the center, and the greater the increase in contact resistance of the bumps on each end.

In the high-speed I/F circuit block HB, the impedance is matched between the transmission side and the reception side in order to prevent signal reflection. Therefore, an impedance mismatch may occur when the contact resistance of the bumps connected to the pads PP and PM of the high-speed I/F circuit block HB increases, whereby the signal quality of high-speed serial transfer may deteriorate. Therefore, it is desirable to dispose the high-speed I/F circuit block HB near the center of the integrated circuit device 10, taking the contact resistance into consideration.

In FIG. 10, the high-speed I/F circuit block HB is disposed between the data driver block DBJ and the scan driver block SB2 instead of on the rightmost end of the integrated circuit device 10. Therefore, an increase in contact resistance of the bumps can be suppressed within an allowable range as compared with the case of disposing the high-speed I/F circuit block HB on the rightmost end of the integrated circuit device 10. If the high-speed I/F circuit block HB is provided in the arrangement region of the data driver blocks DB1 to DBJ taking the contact resistance into consideration to a large extent, the performance of the high-speed I/F circuit block HB decreases due to the effect of noise from the global lines, as described above. According to the layout method shown in FIG. 10, deterioration in performance due to noise from the global lines can be eliminated while suppressing an increase in contact resistance within an allowable range.

6. Shield Line

When providing the long common voltage line VCL on the narrow integrated circuit device 10 along the direction D1, as shown in FIGS. 9A to 9C, the display characteristics may deteriorate if noise from other signal lines is transmitted to the common voltage line VCL. In FIGS. 9A and 9B, for example, noise from the digital signal lines connected to the logic circuit block and the like may be transmitted to the common voltage line VCL. In FIG. 9C, noise from the data signal lines from the data driver block and noise from the scan signal lines from the scan driver block may be transmitted to the common voltage line VCL.

Figure 11A:
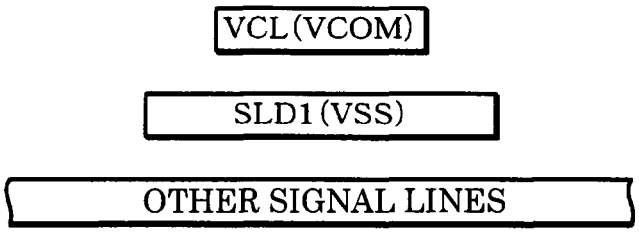
FIGS. 11A to 11C are views illustrative of a common voltage line shielding method.
Figure 11B:
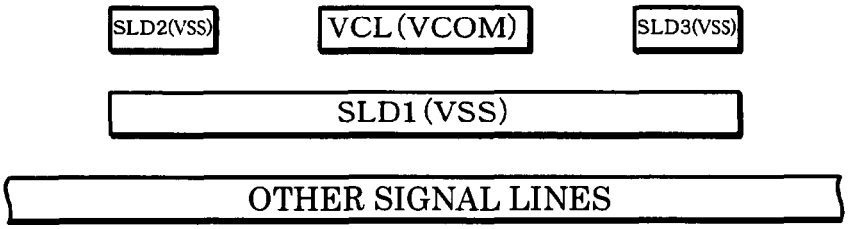
Figure 11C:
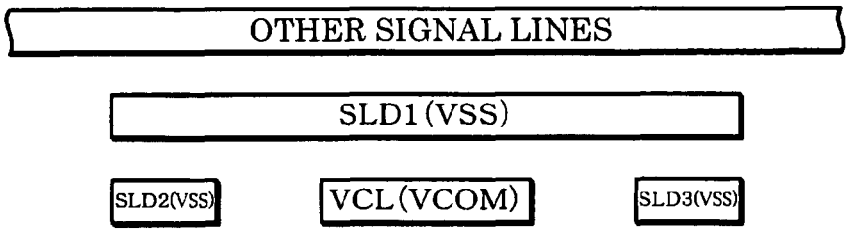

In FIGS. 11A to 11C, shield lines for preventing noise from other signal lines from being transmitted to the common voltage line VCL are provided. In FIG. 11A, for example, a first shield line SLD1 which is formed of an interconnect layer in a layer differing from the common voltage line VCL and to which a given power supply potential (e.g., VSS) is applied is provided to overlap the common voltage line VCL in plan view. Specifically, the shield line SLD1 is provided between the common voltage line VCL and other signal lines. The shield line SLD1 is formed of an interconnect layer provided between the interconnect layer forming the common voltage line VCL and the interconnect layer forming other signal lines. This enables noise from other signal lines (e.g., digital signal lines, data signal lines, and scan signal lines) to be prevented from being transmitted from the lower side of the common voltage line VCL using the shield line SLD1 provided under the common voltage line VCL.

In FIG. 11B, second shield lines SLD2 and SLD3 which are formed of the same interconnect layer as the common voltage line VCL and to which a given power supply potential (e.g., VSS) is applied are provided on either side of the common voltage line VCL. Specifically, when the common voltage line VCL is provided along the direction D1, the shield lines SLD2 and SLD3 are provided along the direction D1 in parallel to the common voltage line VCL at a specific interval from the common voltage line VCL. This enables noise from other signal lines to be prevented from being transmitted from each side of the common voltage line VCL using the shield lines SLD2 and SLD3 provided on either side of the common voltage line VCL.

In FIG. 11B, the shield line SLD1 under the common voltage line VCL is also provided in addition to the shield lines SLD2 and SLD3 on either side of the common voltage line VCL. This enables transmission of noise to the common voltage line VCL to be shielded more efficiently.

When other signal lines are provided over the common voltage line VCL, the shield lines SLD1, SLD2, and SLD3 may be provided as shown in FIG. 11C. Specifically, the shield line SLD1 is provided over the common voltage line VCL, and the shield lines SLD2 and SLD3 are provided on either side of the common voltage line VCL.

7. Panel Common Voltage Line

A method of providing the panel common voltage line on the display panel is described below. In FIGS. 9A to 9C, the common voltage line VCL is provided in the integrated circuit device 10 (chip) to avoid the physical layer circuit PHY. This enables the parasitic resistance of the common voltage line at B2 and B3 in FIG. 8A to be made equal, whereby deterioration in display quality due to the imbalanced parasitic resistance can be reduced.

In order to further reduce the imbalanced parasitic resistance, it is desirable to also provide the panel common voltage line under the integrated circuit device 10 so that the panel common voltage line is formed in the shape of a ring in the peripheral portion of the array substrate 310.

In this case, the voltage level of the panel common voltage line changes in units of horizontal periods. Therefore, if signal noise from the panel common voltage line is superimposed on the differential signals of the physical layer circuit PHY and the like, the physical layer circuit PHY may malfunction. Specifically, if the panel common voltage line is linearly provided along the direction D1 without taking into account the arrangement relationship with the physical layer circuit PHY, the panel common voltage line intersects the differential signal lines and the like. As a result, noise from the panel common voltage line is superimposed on the differential signals through parasitic capacitors and the like, whereby a transfer error or the like may occur.

Figure 12:
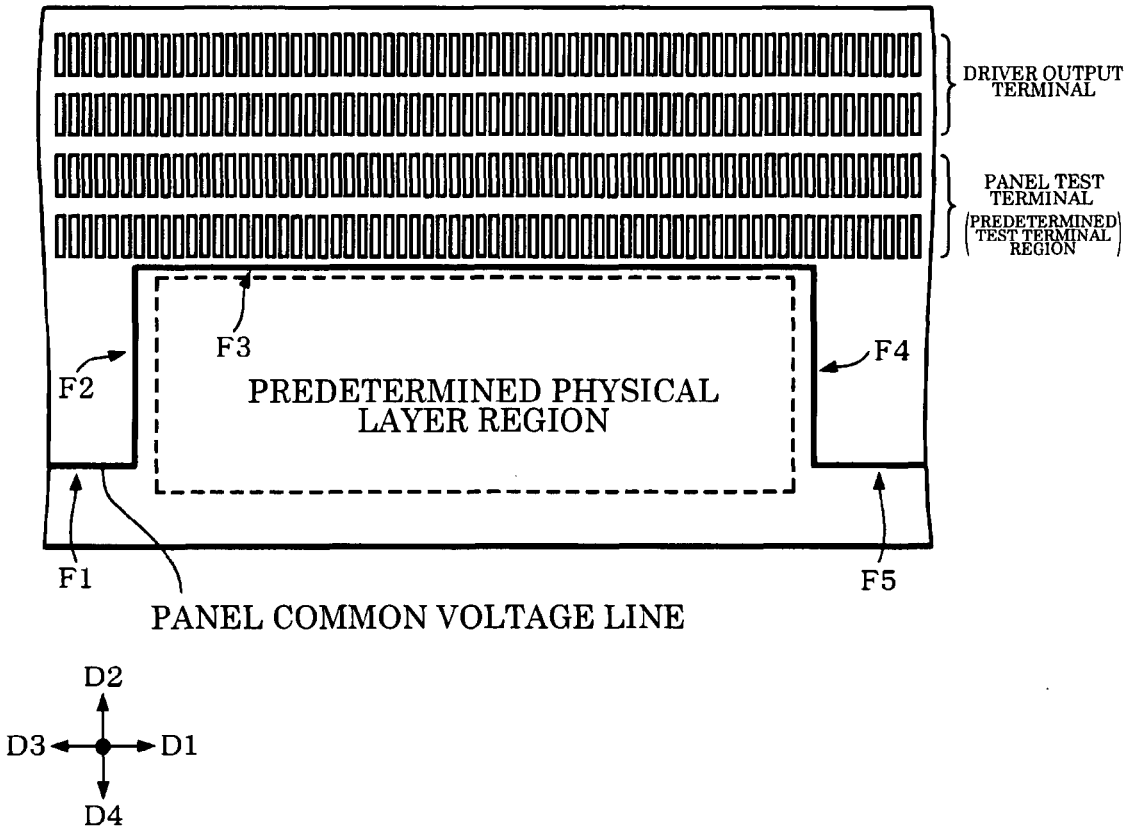
FIG. 12 is a view illustrative of a panel common voltage line wiring method.

In FIG. 12, the panel common voltage line is provided on the display panel to avoid the region of the physical layer circuit disposed over the display panel. Specifically, a region in which the physical layer circuit is located over the display panel when the integrated circuit device is mounted on the display panel is referred to as a predetermined physical layer region, for example. In this case, the panel common voltage line is provided on the display panel in a region which does not overlap the predetermined physical layer region, as shown in FIG. 12.

Specifically, the panel common voltage line is provided on the display panel along the direction D1 which is the long side direction of the integrated circuit device. That is, the panel common voltage line is provided along a direction from a position near the lower side of the pad PC1 shown in FIG. 8B toward a position near the lower side of the pad PC2. The common voltage line VCL is also provided along the direction D1 at a position in the direction D2 with respect to the predetermined physical layer region.

Specifically, the panel common voltage line is provided in the region between the predetermined physical layer region and the panel test terminals. In more detail, the panel common voltage line provided along the direction D1, as indicated by F1 in FIG. 12, turns along the direction D2 at a position in the direction D3 with respect to the predetermined physical layer region to avoid the predetermined physical layer region, as indicated by F2. The panel common voltage line is provided along the direction D1 at a position in the direction D2 with respect to the predetermined physical layer region, as indicated by F3 in FIG. 12. Specifically, the panel common voltage line is provided along the direction D1 in the region between the predetermined physical layer region and the panel test terminals. The panel common voltage line is provided along the direction D4 at a position in the direction D1 with respect to the predetermined physical layer region, as indicated by F4, and then turns along the direction D1, as indicated by F5.

The panel common voltage line is prevented from being provided under the physical layer circuit by providing the panel common voltage line as shown in FIG. 12. This prevents a situation in which signal noise from the panel common voltage line is superimposed on the differential signals and the like, whereby the physical layer circuit malfunctions.

FIG. 12, the panel common voltage line is provided in the region between the panel test terminals and the predetermined physical layer region. Therefore, the panel common voltage line does not intersect the panel test terminals, whereby the wiring efficiency can be increased.

Moreover, the panel common voltage line can be formed in the shape of a ring, as shown in FIG. 8, by providing the panel common voltage line under the integrated circuit device. Therefore, the imbalanced parasitic resistance of the common voltage line can be reduced, whereby deterioration in display quality can be prevented.

8. Circuit Configuration Example of Integrated Circuit Device

Figure 13:
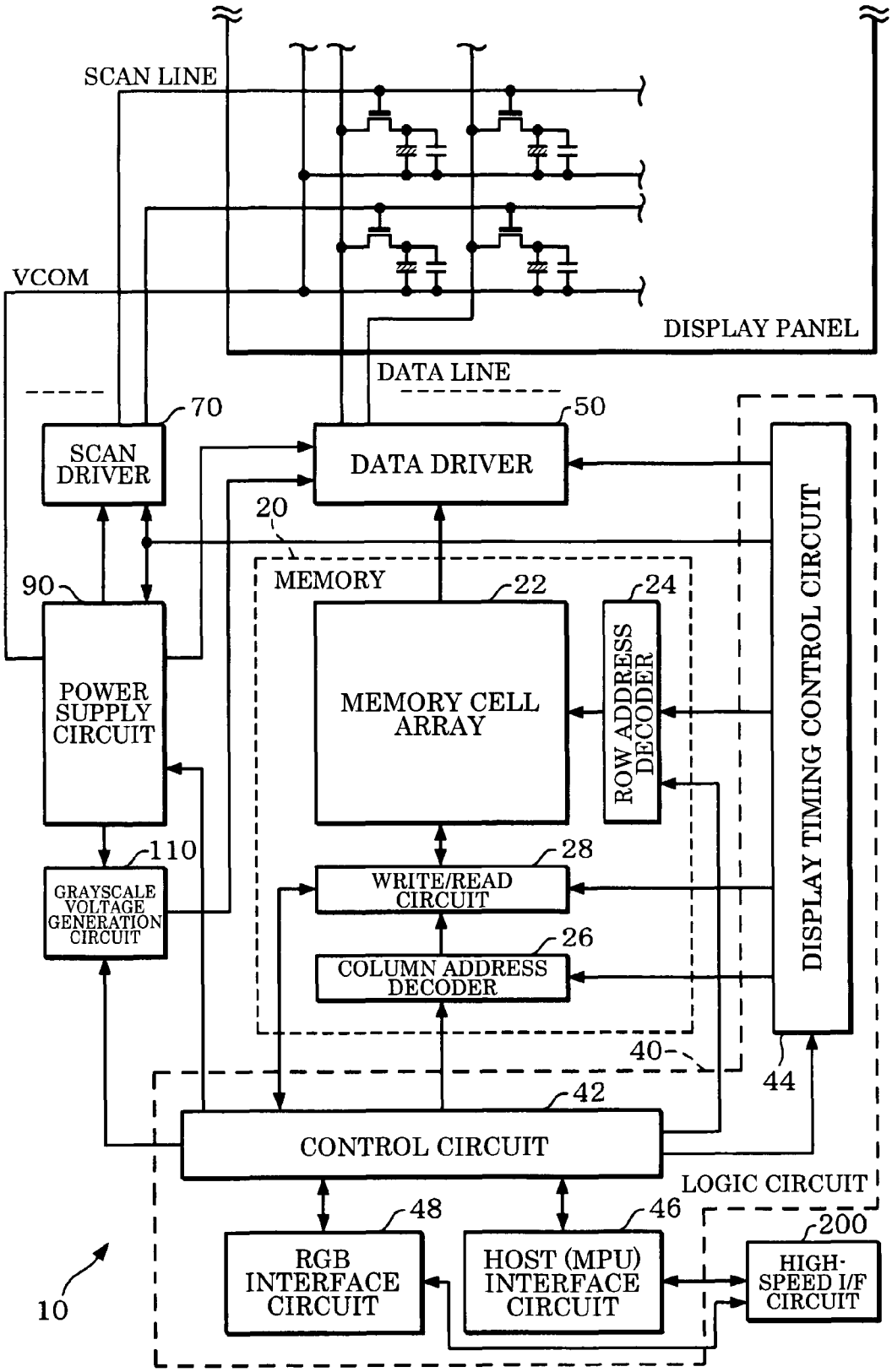
FIG. 13 shows a circuit configuration example of an integrated circuit device.

FIG. 13 shows a circuit configuration example of the integrated circuit device (display driver) according to this embodiment. The integrated circuit device according to this embodiment is not limited to the circuit configuration shown in FIG. 13. Various modification may be made such as omitting some elements or adding other elements.

A display panel includes data lines (source lines), scan lines (gate lines), and pixels, each of the pixels being specified by one of the data lines and one of the scan lines. A display operation is implemented by changing the optical properties of an electro-optical element (liquid crystal element in a narrow sense) in each pixel region. The display panel may be formed using an active matrix type panel using a switching element such as a TFT or TFD. The display panel may be a panel other than the active matrix type panel, or may be a panel (e.g. organic EL panel) other than the liquid crystal panel.

A memory 20 (display data RAM) stores image data. A memory cell array 22 includes memory cells, and stores image data (display data) of at least one frame (one screen). A row address decoder 24 (MPU/LCD row address decoder) decodes a row address, and selects a wordline of the memory cell array 22. A column address decoder 26 (MPU column address decoder) decodes a column address, and selects a bitline of the memory cell array 22. A write/read circuit 28 (MPU write/read circuit) writes image data into the memory cell array 22 or reads image data from the memory cell array 22.

A logic circuit 40 (driver logic circuit) generates a control signal for controlling the display timing, a control signal for controlling the data processing timing, and the like. The logic circuit 40 may be formed by automatic placement and routing (e.g., gate array (G/A)), for example.

A control circuit 42 generates various control signals, and controls the entire device. Specifically, the control circuit 42 outputs grayscale adjustment data (gamma correction data) for adjusting grayscale characteristics (gamma characteristics) to a grayscale voltage generation circuit 110, and outputs power supply adjustment data for adjusting the power supply voltage to a power supply circuit 90. The control circuit 42 also controls a memory write/read process using the row address decoder 24, the column address decoder 26, and the write/read circuit 28. A display timing control circuit 44 generates various control signals for controlling the display timing, and controls reading of image data from the memory 20 into the display panel. A host (MPU) interface circuit 46 implements a host interface for generating an internal pulse and accessing the memory 20 on each occasion of access from a host. An RGB interface circuit 48 implements an RGB interface for writing video image RGB data into the memory 20 based on a dot clock signal. The integrated circuit device may be configured to include only one of the host interface circuit 46 and the RGB interface circuit 48.

A data driver 50 is a circuit which generates a data signal for driving the data line of the display panel. Specifically, the data driver 50 receives the image data (grayscale data) from the memory 20, and receives a plurality of (e.g. 256 stages) grayscale voltages (reference voltages) from the grayscale voltage generation circuit 110. The data driver 50 selects the voltage corresponding to the image data from the grayscale voltages, and outputs the selected voltage to the data line of the display panel as the data signal (data voltage).

A scan driver 70 is a circuit which generates a scan signal for driving the scan line of the display panel. Specifically, the scan driver 70 sequentially shifts a signal (enable input/output signal) using a built-in shift register, and outputs a signal obtained by converting the level of the shifted signal to each scan line of the display panel as the scan signal (scan voltage). The scan driver 70 may include a scan address generation circuit and an address decoder. The scan address generation circuit may generate and output a scan address, and the address decoder may decode the scan address to generate the scan signal.

The power supply circuit 90 is a circuit which generates various power supply voltages. Specifically, the power supply circuit 90 increases an input power supply voltage or an internal power supply voltage by a charge-pump method using a boost capacitor and a boost transistor included in a voltage booster circuit provided in the power supply circuit 90. The power supply circuit 90 supplies the resulting voltages to the data driver 50, the scan driver 70, the grayscale voltage generation circuit 110, and the like.

The grayscale voltage generation circuit 110 (gamma correction circuit) is a circuit which generates the grayscale voltage and supplies the grayscale voltage to the data driver 50. Specifically, the grayscale voltage generation circuit 110 may include a ladder resistor circuit which divides the voltage between the high-potential-side power supply and the low-potential-side power supply using resistors, and outputs the grayscale voltages to resistance division nodes. The grayscale voltage generation circuit 110 may also include a grayscale register section into which the grayscale adjustment data is written, a grayscale voltage setting circuit which variably sets (controls) the grayscale voltage output to the resistance division node based on the written grayscale adjustment data, and the like.

Figure 14A:
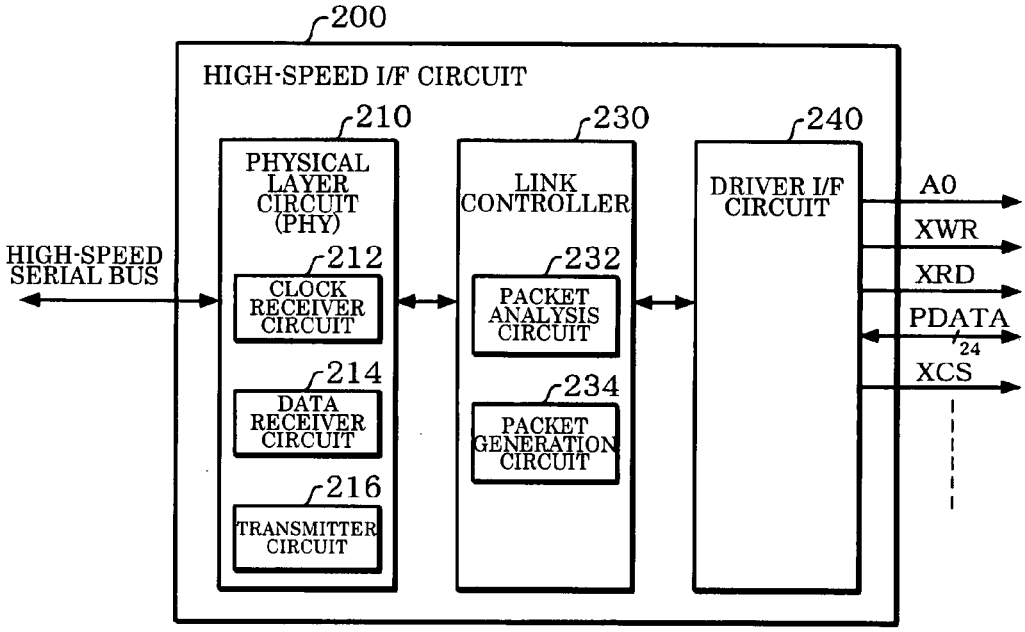
FIGS. 14A and 14B show a configuration example of a high-speed I/F circuit and a physical layer circuit.

A high-speed I/F circuit 200 (serial interface circuit) is a circuit which implements a high-speed serial transfer through a serial bus. Specifically, the high-speed I/F circuit 200 implements a high-speed serial transfer between the integrated circuit device and the host (host device) by current-driving or voltage-driving differential signal lines of the serial bus. FIG. 14A shows a configuration example of the high-speed I/F circuit 200.

A physical layer circuit 210 (transceiver) is a circuit which receives or transmits data (packet) and a clock signal using differential signals (differential data signals and differential clock signals). Specifically, the physical layer circuit 210 transmits or receives data and the like by current-driving or voltage-driving differential signal lines of the serial bus. The physical layer circuit 210 may include a clock receiver circuit 212, a data receiver circuit 214, a transmitter circuit 216, and the like.

The link controller 230 performs a process of a link layer (or transaction layer) higher than the physical layer. Specifically, the link controller 230 may include a packet analysis circuit 232. When the physical layer circuit 210 has received a packet from the host (host device) through the serial bus, the packet analysis circuit 232 analyzes the received packet. Specifically, the packet analysis circuit 232 separates the header and data of the received packet and extracts the header. The link controller 230 may include a packet generation circuit 234. The packet generation circuit 234 generates a packet when transmitting a packet to the host through the serial bus. Specifically, the packet generation circuit 234 generates the header of the packet to be transmitted, and assembles the packet by combining the header and data. The packet generation circuit 234 directs the physical layer circuit 210 to transmit the generated packet.

The driver I/F circuit 240 performs an interface process between the high-speed I/F circuit 200 and an internal circuit of the display driver. Specifically, the driver I/F circuit 240 generates host interface signals including an address 0 signal A0, a write signal XWR, a read signal XRD, a parallel data signal PDATA, a chip select signal XCS, and the like, and outputs the generated signals to the internal circuit (host interface circuit 46) of the display driver.

Figure 14B:
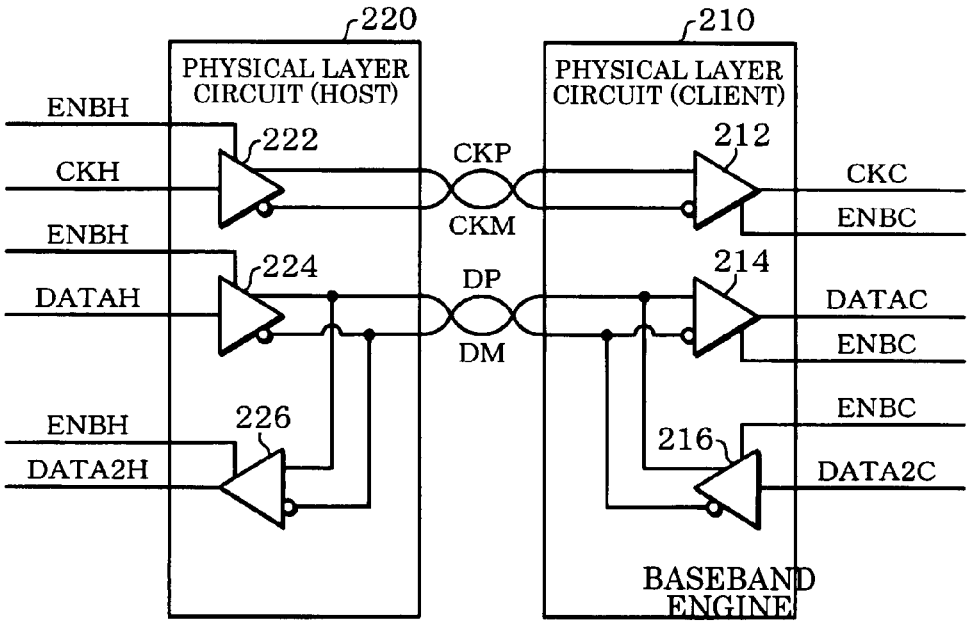

In FIG. 14B, a physical layer circuit 220 is provided in the host device, and the physical layer circuit 210 is provided in the display driver. Reference numerals 212, 214, and 226 indicate receiver circuits, and reference numerals 216, 222, and 224 indicate transmitter circuits. The operations of the receiver circuits 212, 214, and 226 and the transmitter circuits 216, 222, and 224 are enabled or disabled using enable signals ENBH and ENBC.

The host-side clock transmitter circuit 222 outputs differential clock signals CKP and CKM. The client-side clock receiver circuit 212 differentially amplifies the differential clock signals CKP and CKM, and outputs the resulting clock signal CKC to the circuit in the subsequent stage.

The host-side data transmitter circuit 224 outputs differential data signals DP and DM. The client-side data receiver circuit 214 differentially amplifies the differential data signals DP and DM, and outputs the resulting data DATAC to the circuit in the subsequent stage. In FIG. 14B, data can be transferred from the client to the host using the client-side data transmitter circuit 216 and the host-side data receiver circuit 226.

The configuration of the physical layer circuit 210 is not limited to FIGS. 14A and 14B. Various modifications may be made. For example, the physical layer circuit 210 may include a serial/parallel conversion circuit, a parallel/serial conversion circuit, and the like (not shown). Or, the physical layer circuit 210 may include a phase locked loop (PLL) circuit, a bias voltage generation circuit, and the like. The differential signal lines of the serial bus may have a multi-channel configuration. The physical layer circuit 210 includes at least one of the receiver circuit and the transmitter circuit. For example, the physical layer circuit 210 may not include the transmitter circuit. A sampling clock signal may be generated based on the received data without providing the clock receiver circuit.

9. Narrow Integrated Circuit Device

Figure 15:
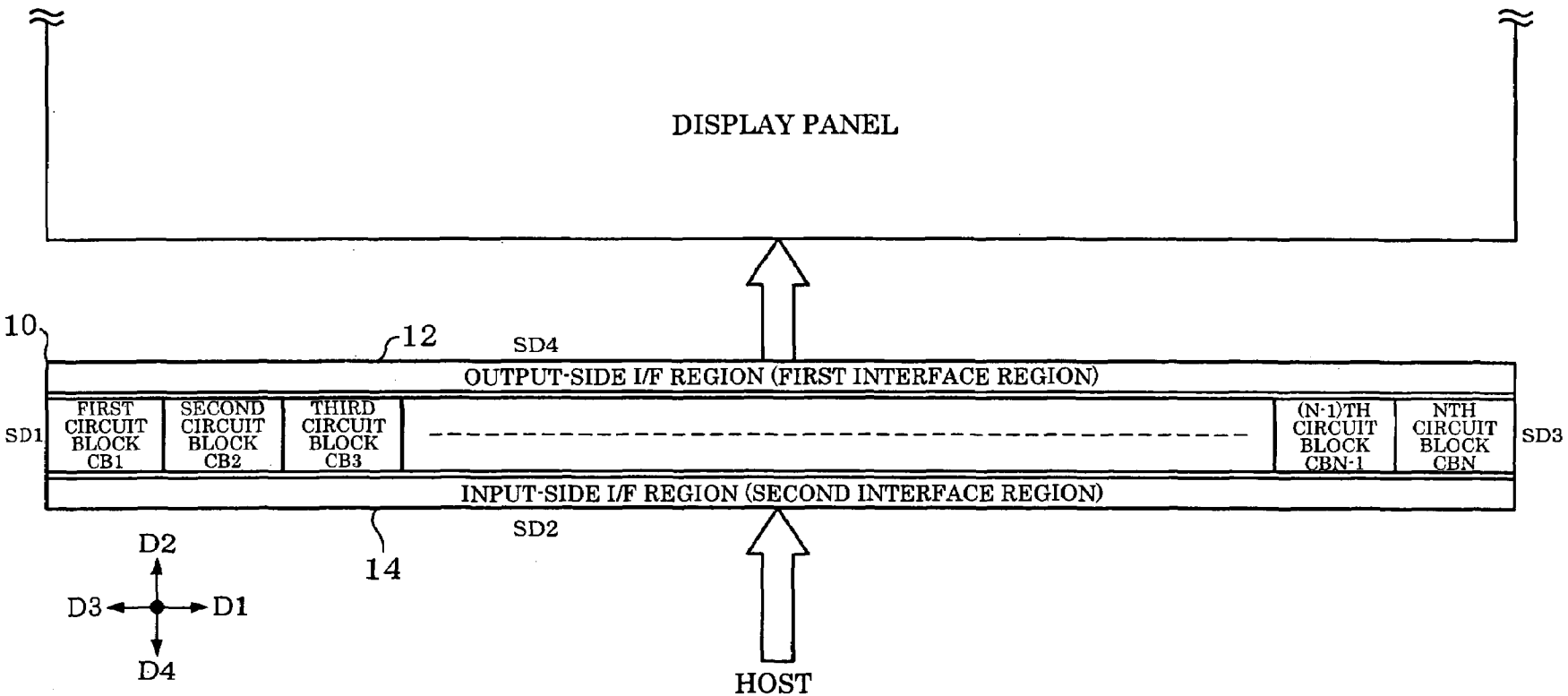
FIG. 15 shows an arrangement configuration example of an integrated circuit device.

FIG. 15 shows an arrangement example of the integrated circuit device 10. The integrated circuit device 10 includes first to Nth circuit blocks CB1 to CBN (N is an integer equal to or larger than two) disposed along the direction D1. The integrated circuit device 10 includes an output-side I/F region 12 (first interface region in a broad sense) provided along the side SD4 in the direction D2 with respect to the first to Nth circuit blocks CB1 to CBN. The integrated circuit device 10 includes an input-side I/F region 14 (second interface region in a broad sense) provided along the side SD2 in the direction D4 with respect to the first to Nth circuit blocks CB1 to CBN. Specifically, the output-side I/F region 12 is disposed in the direction D2 with respect to the circuit blocks CB1 to CBN without another circuit block or the like provided in between, for example. When the integrated circuit device 10 is used as an intellectual property (IP) core and is incorporated in another integrated circuit device, at least one of the output-side I/F region 12 and the input-side I/F region 14 (first and second I/O regions) may be omitted from the integrated circuit device 10.

The output-side (display panel side) I/F region 12 is a region which serves as an interface between the integrated circuit device 10 and the display panel, and may include pads and elements connected to the pads, such as output transistors and protective elements. Specifically, the output-side I/F region 12 may include output transistors for outputting the data signals to the data lines and outputting the scan signals to the scan lines, for example. When the display panel is a touch panel or the like, the output-side I/F region 12 may include input transistors.

The input-side (host-side) I/F region 14 is a region which serves as an interface between the integrated circuit device 10 and a host (MPU, image processing controller, or baseband engine), and may include pads and elements connected to the pads, such as input (input/output) transistors, output transistors, and protective elements. Specifically, the input-side I/F region 14 may include input transistors for inputting signals (digital signals) from the host, output transistors for outputting signals to the host, and the like.

An output-side I/F region or an input-side I/F region may be provided along the short side SD1 or SD3. Bumps serving as external connection terminals and the like may be provided in the I/F (interface) regions 12 and 14, or may be provided in a region (first to Nth circuit blocks CB1 to CBN) other than the I/F (interface) regions 12 and 14. When providing the bumps in a region other than the I/F regions 12 and 14, the bumps are formed using a small bump technology (e.g. bump technology using a resin core) other than a gold bump technology.

The first to Nth circuit blocks CB1 to CBN may include at least two (or three) different circuit blocks (circuit blocks having different functions). For example, when the integrated circuit device 10 is a display driver, the circuit blocks CB1 to CBN may include at least two of a data driver block, a memory block, a scan driver block, a logic circuit block, a grayscale voltage generation circuit block, and a power supply circuit block. Specifically, the circuit blocks CB1 to CBN may include at least a data driver block and a logic circuit block, and may further include a grayscale voltage generation circuit block. When the integrated circuit device 10 includes a built-in memory, the circuit blocks CB1 to CBN may include a memory block.

Figure 16A:
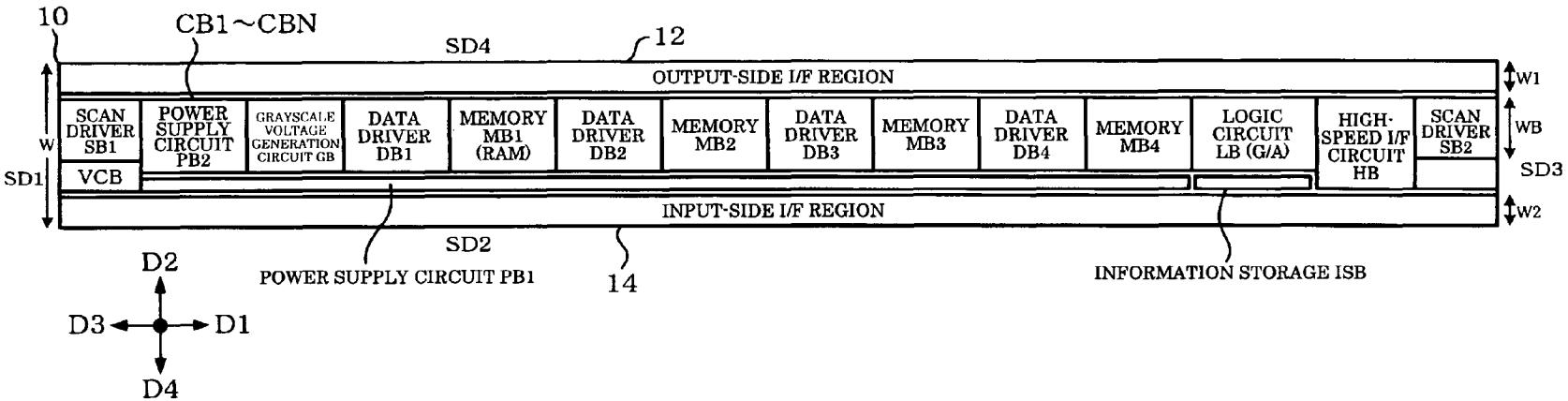
FIGS. 16A and 16B show a planar layout example of an integrated circuit device.
Figure 16B:
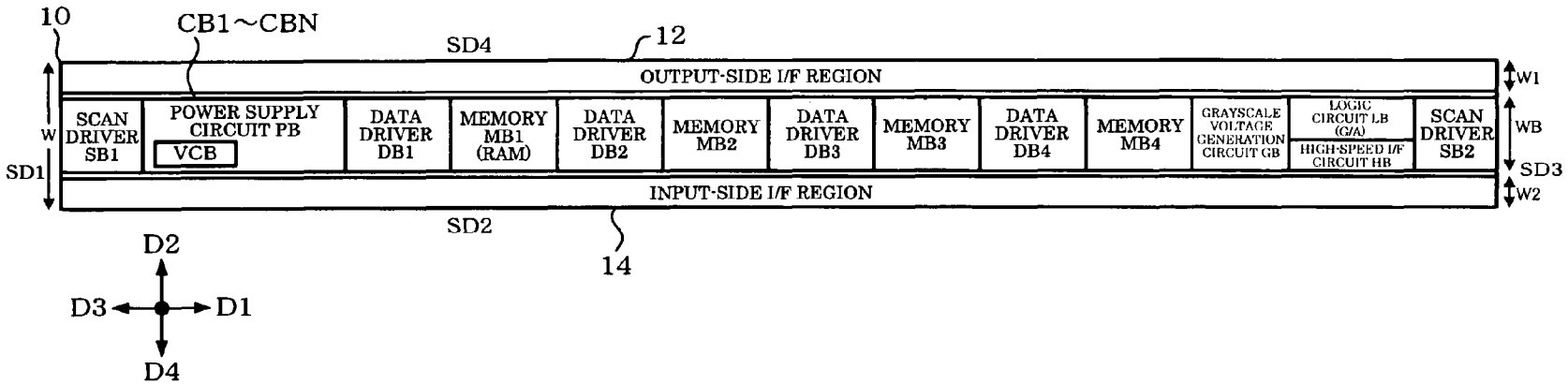

FIGS. 16A and 16B show detailed examples of the planar layout of the integrated circuit device 10. In FIGS. 16A and 16B, the first to Nth circuit blocks CB1 to CBN include first to fourth memory blocks MB1 to MB4 (first to Ith memory blocks in a broad sense; I is an integer equal to or larger than two). The first to Nth circuit blocks CB1 to CBN include first to fourth data driver blocks DB1 to DB4 (first to Ith data driver blocks in a broad sense) respectively disposed adjacent to the first to fourth memory blocks MB1 to MB4 along the direction D1. Specifically, the memory block MB1 and the data driver block DB1 are adjacently disposed along the direction D1, and the memory block MB2 and the data driver block DB2 are adjacently disposed along the direction D1. The memory block MB1 adjacent to the data driver block DB1 stores image data (display data) for the data driver block DB1 to drive the data line, and the memory block MB2 adjacent to the data driver block DB2 stores image data for the data driver block DB2 to drive the data line.

In FIGS. 16A and 16B, scan driver blocks SB1 and SB2 are disposed on either end of the integrated circuit device 10. A modification may be made in which only one of the scan driver blocks SB1 and SB2 is provided or the scan driver blocks SB1 and SB2 are not provided.

In FIG. 16A, the grayscale voltage generation circuit block GB and the power supply circuit block PB2 are disposed in the direction D3 with respect to the data driver blocks DB1 to DB4 (memory blocks MB1 to MB4). The logic circuit block LB and the high-speed I/F circuit block HB are disposed in the direction D1 with respect to the data driver blocks DB1 to DB4 (MB1 to MB4). The grayscale voltage generation circuit block GB is disposed between the power supply circuit block PB2 and the data driver blocks DB1 to DB4 (MB1 to MB4). The logic circuit block LB and the high-speed I/F circuit block HB are adjacently disposed along the direction D1. An information storage block ISB is provided in the direction D4 with respect to the logic circuit block LB.

In FIG. 16A, a narrow power supply circuit block PB1 is disposed along the direction D1 between the circuit blocks CB1 to CBN (data driver blocks DB1 to DB4) and the input-side I/F region 14 (second interface region). The power supply circuit block PB1 is a circuit block which has a long side along the direction D1 and a short side along the direction D2 and has a significantly small width in the direction D2 (narrow circuit block with a width equal to or less than a width WB). The power supply circuit block PB1 may include boost transistors of a voltage booster circuit which increases voltage by a charge-pump operation, a boost control circuit, and the like. The power supply circuit block PB2 may include a power supply register section into which power supply adjustment data for adjusting the power supply voltage is written, a regulator which regulates voltage increased by a voltage booster circuit which increases voltage by a charge pump operation, and the like.

In FIG. 16B, the grayscale voltage generation circuit block GB and the logic circuit block LB are disposed adjacently. The data driver blocks DB1 to DB4 (MB1 to MB4) are disposed between the power supply circuit block PB and the grayscale voltage generation circuit block GB and the logic circuit block LB. This enables the grayscale voltage setting signal from the logic circuit block LB to be input to the grayscale voltage generation circuit block GB along a short path.

In FIG. 16B, the high-speed I/F circuit block HB (physical layer circuit) is disposed in the direction D4 with respect to the logic circuit block LB. This enables the differential input signals from the differential input pads to be input to the high-speed I/F circuit block HB along a short path while enabling the signal from the high-speed I/F circuit block HB to be input to the logic circuit block LB along a short path.

The layout arrangement of the integrated circuit device 10 according to this embodiment is not limited to FIGS. 16A and 16B. For example, the number of memory blocks or data driver blocks may be two, three, or five or more, or the memory block and the data driver block may not be divided into subblocks. A modification may also be made in which the memory block is not adjacent to the data driver block. A configuration may be employed in which the memory block, the scan driver block, the power supply circuit block, the grayscale voltage generation circuit block, or the like is not provided. For example, the memory block may be omitted when the integrated circuit device 10 does not include a memory. The scan driver block may be omitted when the scan driver can be formed on the glass substrate of the display panel. In a display driver for a color super twisted nematic (CSTN) panel or a thin film diode (TFD) panel, the grayscale voltage generation circuit block may be omitted. A circuit block having a significantly small width in the direction D2 (narrow circuit block with a width equal to or less than the width WB) may be provided between the circuit blocks CB1 to CBN and the output-side I/F region 12 or the input-side I/F region 14. The circuit blocks CB1 to CBN may include a circuit block in which different circuit blocks are arranged in stages along the direction D2. For example, the scan driver circuit and the power supply circuit may be integrated into one circuit block.

Figure 17A:
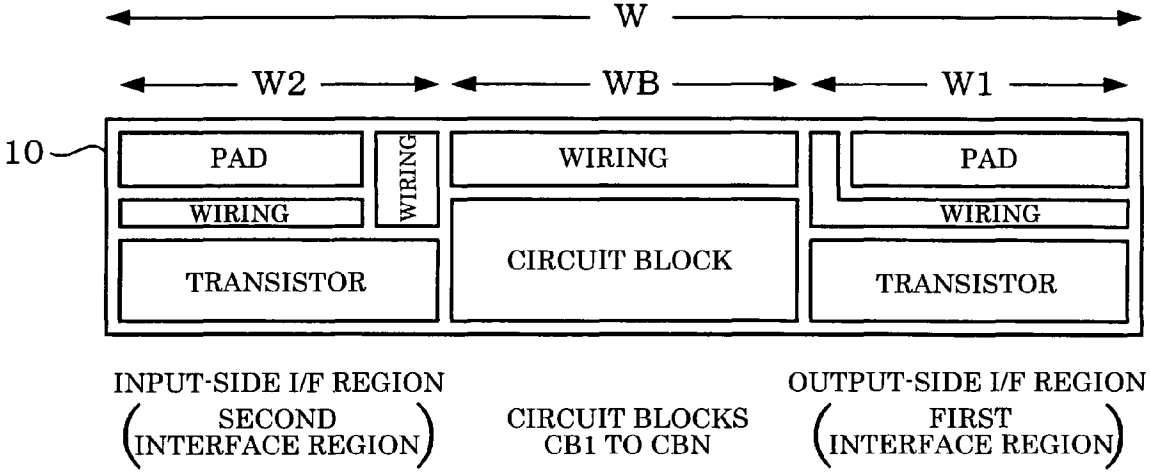
FIGS. 17A and 17B show examples of the cross-sectional view of an integrated circuit device.

FIG. 17A shows an example of a cross-sectional view of the integrated circuit device 10 along the direction D2. W1, WB, and W2 respectively indicate the widths of the output-side I/F region 12, the circuit blocks CB1 to CBN, and the input-side I/F region 14 in the direction D2. The widths W1, WB, and W2 indicate the widths (maximum widths) of the transistor formation regions (bulk region or active region) of the output-side I/F region 12, the circuit blocks CB1 to CBN, and the input-side I/F region 14, respectively, and exclude the bump formation regions. W indicates the width of the integrated circuit device 10 in the direction D2. In this case, the relationship $W1+WB+W2 \leqq W < W1+2\times WB+W2$ is satisfied, for example. Or, since $W1+W2<WB$ is satisfied, $W<2\times WB$ is satisfied.

Figure 17B:
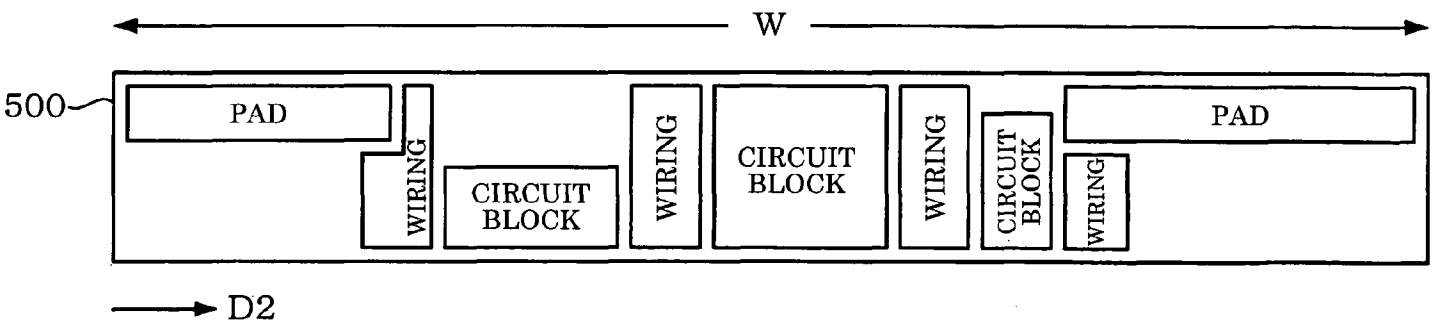

According to the arrangement method shown in FIG. 17B, two or more circuit blocks having a large width in the direction D2 are disposed along the direction D2. Specifically, the data driver block and the memory block are disposed along the direction D2.

In FIG. 17B, image data from the host is written into the memory block, for example. The data driver block converts the digital image data written into the memory block into an analog data voltage, and drives the data line of the display panel. Therefore, the image data signal flows along the direction D2. In FIG. 17B, the memory block and the data driver block are disposed along the direction D2 corresponding to the signal flow.

However, the arrangement method shown in FIG. 17B has the following problems.

First, a reduction in chip size is required for an integrated circuit device such as a display driver in order to reduce cost. However, if the chip size is reduced by merely shrinking the integrated circuit device using a microfabrication technology, the size of the integrated circuit device is reduced not only in the short side direction but also in the long side direction. This makes mounting difficult due to the narrow pitch.

Second, the configurations of the memory and the data driver of the display driver are changed depending on the type of display panel (amorphous TFT or low-temperature polysilicon TFT), the number of pixels (QCIF, QVGA, or VGA), the specification of the product, and the like. According to the arrangement method shown in FIG. 17B, even if the pad pitch, the cell pitch of the memory, and the cell pitch of the data driver coincide in a certain product, the pitches do not coincide when the configurations of the memory and the data driver are changed. If the pitches do not coincide, an unnecessary wiring region must be formed between the circuit blocks in order to absorb the difference in pitch. As a result, the width of the integrated circuit device in the direction D2 increases, whereby cost is increased due to an increase in the chip area. If the layout of the memory and the data driver is changed so that the pad pitch coincides with the cell pitch in order to avoid such a situation, the development period increases, whereby cost is increased.

According to the arrangement method shown in FIGS. 15 to 16B, the circuit blocks CB1 to CBN are disposed along the direction D1. In FIG. 17A, the transistor (circuit element) can be disposed under the pad (bump) (active surface bump). Moreover, signal lines between the circuit blocks and between the circuit block and the I/F region can be formed using global lines formed in an upper layer (lower layer of the pads) of local lines provided in the circuit blocks. Therefore, the width W of the integrated circuit device 10 in the direction D2 can be reduced while maintaining the length of the integrated circuit device 10 in the direction D1, whereby a narrow chip can be realized.

According to the arrangement method shown in FIGS. 15 to 16B, since the circuit blocks CB1 to CBN are disposed along the direction D1, it is possible to easily deal with a change in the product specification and the like. Specifically, products of various specifications can be designed using a common platform, whereby the design efficiency can be improved. For example, when the number of pixels or the number of grayscales of the display panel is increased or decreased, it is possible to deal with such a situation by merely increasing or decreasing the number of memory blocks or data driver blocks, the image data read count in one horizontal scan period, and the like. For example, when the scan driver can be formed on the display panel such as a low-temperature polysilicon TFT panel, it suffices to remove the scan driver block from the circuit blocks CB1 to CBN. When developing a product without a memory, it suffices to remove the memory block. Even if the circuit block is removed conforming to the specification, its effects on the remaining circuit blocks are minimized, whereby the design efficiency can be improved.

According to the arrangement method shown in FIGS. 15 to 16B, the widths (heights) of the circuit blocks CB1 to CBN in the direction D2 can be adjusted to the width (height) of the data driver block or the memory block, for example. When the number of transistors of each circuit block is increased or decreased, it is possible to deal with such a situation by increasing or decreasing the length of each circuit block in the direction D1. Therefore, the design efficiency can be further improved. For example, when the number of transistors of each circuit block is increased or decreased due to a change in the configuration of the grayscale voltage generation circuit block or the logic circuit block, it is possible to deal with such a situation by increasing or decreasing the length of the grayscale voltage generation circuit block or the logic circuit block in the direction D1.

10. Grayscale Voltage Generation Circuit

Figure 18:
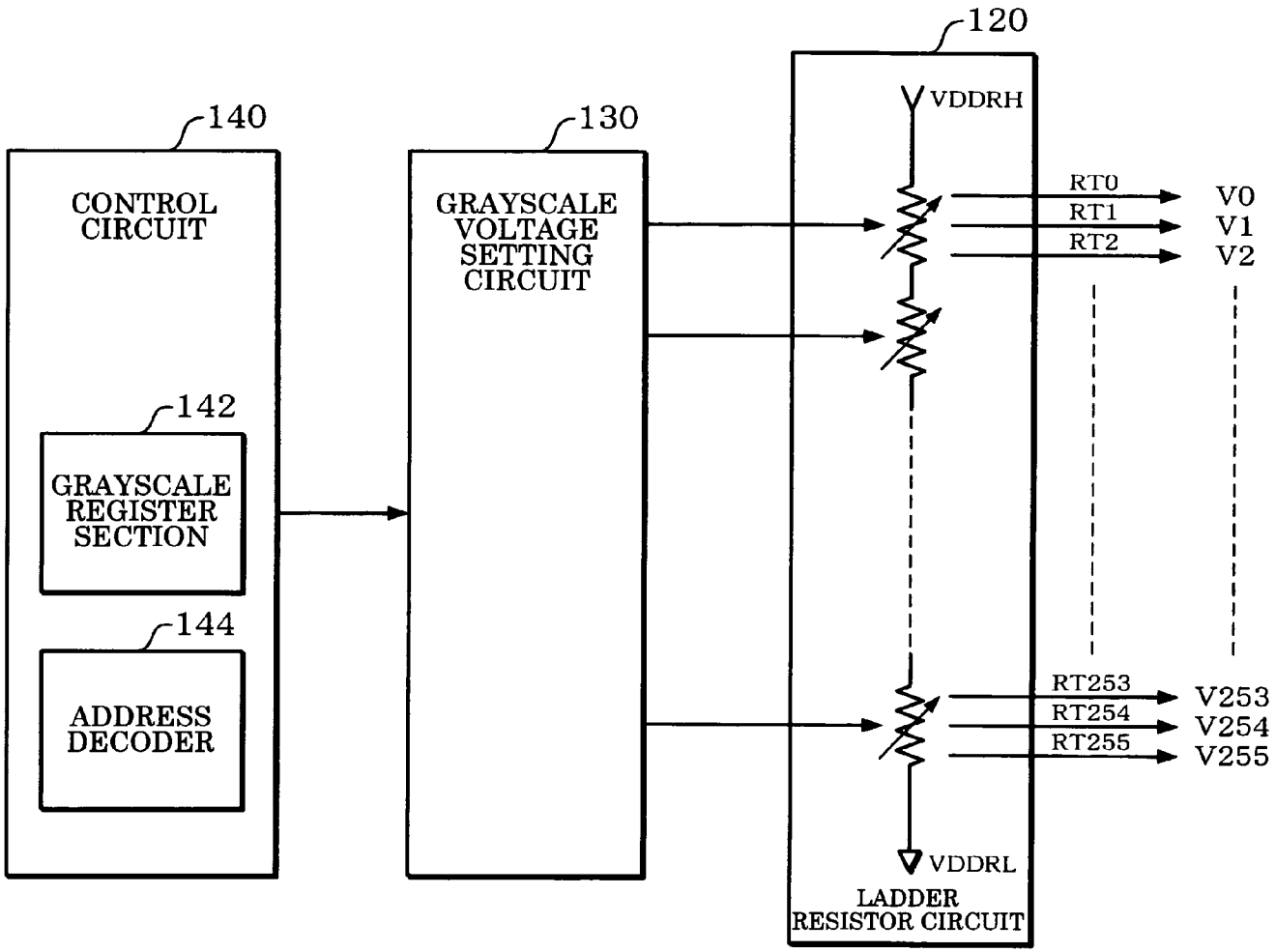
FIG. 18 shows a configuration example of a grayscale voltage generation circuit.

FIG. 18 shows a configuration example of the grayscale voltage generation circuit. The grayscale voltage generation circuit includes a ladder resistor circuit 120, a grayscale voltage setting circuit 130, and a control circuit 140.

The ladder resistor circuit 120 divides the voltage between a high-potential-side power supply (power supply voltage) VDDRH and a low-potential-side power supply (power supply voltage) VDDRL using resistors, and outputs one of grayscale voltages V0 to V255 to each of resistance division nodes RT0 to RT255.

The control circuit 140 includes a grayscale register section 142 and an address decoder 144. The grayscale adjustment data (data for adjusting grayscale characteristics) from the logic circuit (logic circuit block) is written into the grayscale register section 142. The address decoder 144 decodes an address signal from the logic circuit, and outputs a register address signal corresponding to the address signal. In the grayscale register section 142, the grayscale adjustment data is written into a register of which the register address signal from the address decoder 144 is active based on a latch signal from the logic circuit.

The grayscale voltage setting circuit 130 (grayscale selector) variably sets (controls) the grayscale voltage output to the resistance division nodes RT0 to RT255 based on the grayscale adjustment data written into the grayscale register section 142. Specifically, the grayscale voltage setting circuit 130 variably sets the grayscale voltage by variably controlling the resistance values of variable resistance circuits included in the ladder resistor circuit 120.

The grayscale voltage generation circuit is not limited to the configuration shown in FIG. 18. Various modifications may be made such as omitting some of the elements shown in FIG. 18 or adding other elements. For example, a positive ladder resistor circuit and a negative ladder resistor circuit may be provided, or a circuit (voltage-follower-connected operational amplifier) which subjects the grayscale voltage signal to impedance conversion may be provided. Or, the grayscale voltage generation circuit may include a select voltage generation circuit and a grayscale voltage select circuit. In this case, the grayscale voltage generation circuit outputs voltages obtained by division using a ladder resistor circuit included in the select voltage generation circuit as select voltages. When the number of grayscales is 256, for example, the grayscale voltage select circuit selects 64 (S in a broad sense) voltages from the select voltages from the select voltage generation circuit based on the grayscale adjustment data, and outputs the selected voltages as the grayscale voltages V0 to V255.

In FIG. 19A, the circuit blocks CB1 to CBN include the grayscale voltage generation circuit block GB, the data driver blocks DB1, DB2, . . . , and the logic circuit block LB. The logic circuit block LB transfers the grayscale adjustment data for adjusting the grayscale voltage to the grayscale voltage generation circuit block GB. The grayscale voltage generation circuit block GB generates grayscale voltages based on the transferred grayscale adjustment data. For example, the grayscale voltage generation circuit block GB adjusts the grayscale voltage, and outputs the adjusted grayscale voltage.

In FIG. 19A, the data driver block DB1, DB2, . . . are disposed between the grayscale voltage generation circuit block GB and the logic circuit block LB.

According to the layout method shown in FIG. 19A, the data driver block DB1, DB2, . . . can be disposed around the center of the integrated circuit device. Therefore, the data driver (source driver) pads and the like can be disposed by utilizing the free space in the direction D2 with respect to the data driver block DB1, DB2, whereby the free space can be effectively utilized.

According to the layout method shown in FIG. 19A, the grayscale voltage generation circuit block GB and the logic circuit block LB can be respectively disposed on the left and the right of the data driver block DB1, DB2, . . . . Therefore, the scan driver (gate driver) pads and the like can be disposed by utilizing the free space in the direction D2 with respect to the grayscale voltage generation circuit block GB and the logic circuit block LB, whereby the free space can be effectively utilized.

In FIG. 19B, the logic circuit block LB transfers the grayscale adjustment data (grayscale voltage adjustment data) to the grayscale voltage generation circuit block GB by time division through n-bit (n is a positive integer) grayscale transfer lines GTL. For example, the logic circuit block LB transfers (serially transfers) and writes j-bit (j>n) grayscale adjustment data into the grayscale register section 142 of the grayscale voltage generation circuit block GB by time division in units of n bits.

Specifically, it is desirable to set grayscale characteristics (gamma characteristics) optimum for the type of display panel in order to increase the display quality. When enabling the grayscale characteristics to be adjusted corresponding to the characteristics of various display panels, the amount of grayscale adjustment data increases. Therefore, when parallely writing a large amount of grayscale adjustment data into the grayscale register section 142 instead of time division, the number of bits of the transfer line increases, whereby the number of transfer lines increases. According to the layout method in which the data driver blocks DB1, DB2, . . . are disposed between the grayscale voltage generation circuit block GB and the logic circuit block LB, the number of global lines for controlling the data driver supplying the power supply voltage, and supplying the grayscale voltage is limited if the number of transfer lines increases. As a result, the width of the integrated circuit device in the direction D2 increases by the number of grayscale adjustment data transfer lines, thereby making it difficult to realize a narrow chip.

In this case, the grayscale voltage generation circuit block GB and the logic circuit block LB may be disposed adjacently, and the grayscale adjustment data may be transferred using the local lines connecting the grayscale voltage generation circuit block GB and the logic circuit block LB. According to this method, the grayscale voltage generation circuit block GB and the logic circuit block LB are disposed on the right or left of the data driver block DB1, DB2, . . . . Therefore, the free space for disposing the scan driver pads and the like is formed on the right or left of the data driver block DB1, DB2, . . . , whereby the layout efficiency decreases.

On the other hand, the number of grayscale transfer lines GTL can be reduced by transferring the grayscale adjustment data by time division, as shown in FIG. 19B. This provides a space for other global lines, whereby the width of the integrated circuit device in the direction D2 can be reduced. As a result, a narrow chip can be realized. Moreover, the free space for disposing the scan driver pads and the like is equally formed on the right or left of the data driver block DB1, DB2, . . . , whereby the layout efficiency can be increased.

11. Global Wiring Method

In order to reduce the width of the integrated circuit device in the direction D2, it is necessary to efficiently provide the signal lines and the power supply lines between the circuit blocks disposed along the direction D1. Therefore, it is desirable to provide the signal lines and the power supply lines between the circuit blocks using a global wiring method.

According to the global wiring method, local lines formed of interconnect layers (e.g. first to fourth aluminum interconnect layers ALA, ALB, ALC, and ALD) located under an Ith layer (I is an integer equal to or larger than three) are provided between the adjacent circuit blocks among the first to Nth circuit blocks CB1 to CBN. Global lines formed of an interconnect layer (e.g. fifth aluminum interconnect layer ALE) located over the Ith layer are provided between the nonadjacent circuit blocks among the first to Nth circuit blocks CB1 to CBN to pass over the circuit block disposed between the nonadjacent circuit blocks along the direction D1.

Figure 20:
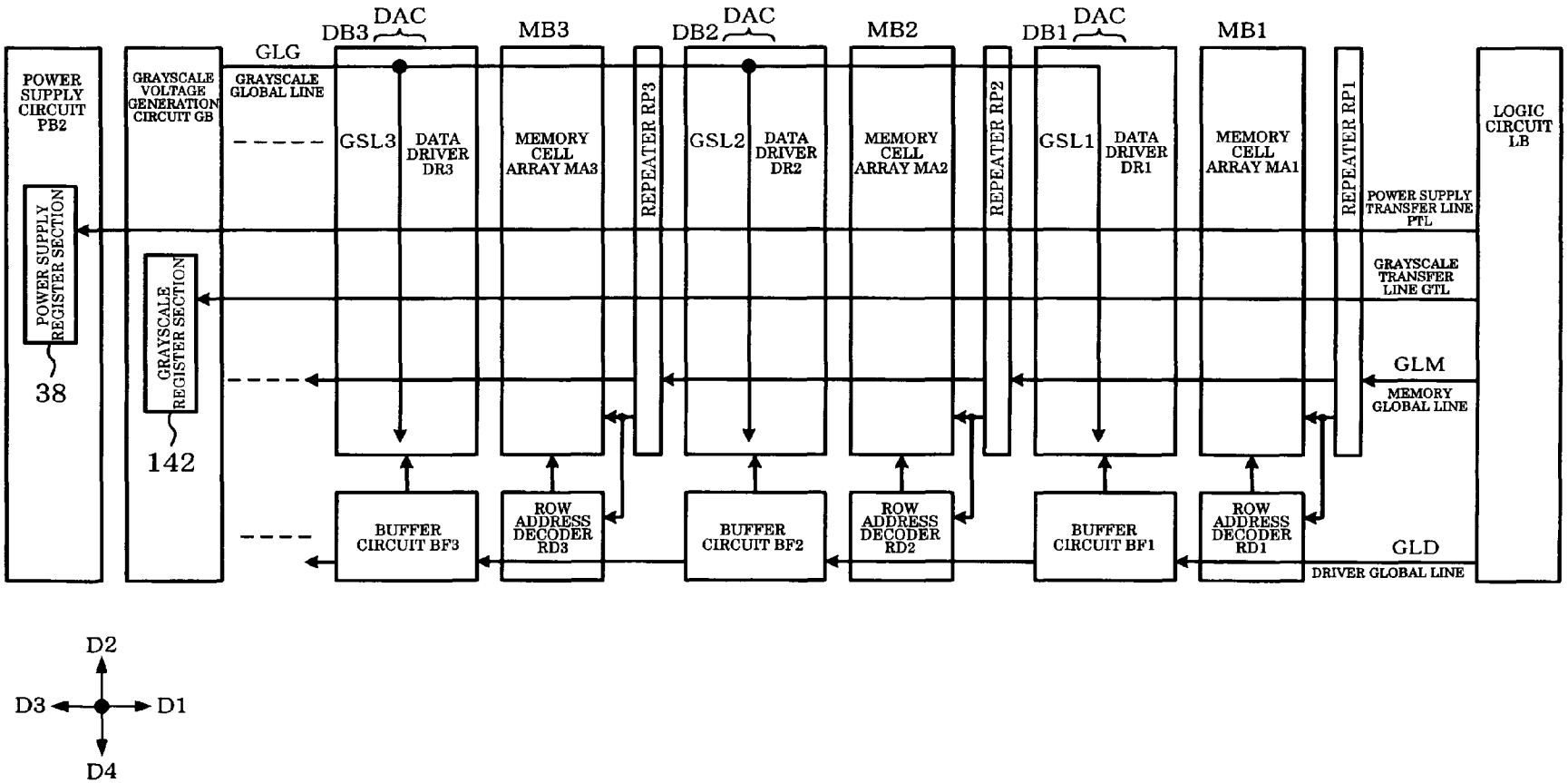
FIG. 20 is a view illustrative of a global wiring method.

FIG. 20 shows a wiring example of the global lines. In FIG. 20, a driver global line GLD for supplying a driver control signal from the logic circuit block LB to the data driver blocks DB1 to DB3 is provided over buffer circuits BF1 to BF3 and row address decoders RD1 to RD3. Specifically, the driver global line GLD formed of the fifth aluminum interconnect layer ALE (top metal) is provided almost linearly from the logic circuit block LB along the direction D1 over the buffer circuits BF1 to BF3 and the row address decoders RD1 to RD3. The driver control signal supplied through the driver global line GLD is buffered by the buffer circuits BF1 to BF3 and input to the data drivers DR1 to DR3 disposed in the direction D2 with respect to the buffer circuits BF1 to BF3.

In FIG. 20, a memory global line GLM for supplying at least a write data signal (or address signal or memory control signal) from the logic circuit block LB to the memory blocks MB1 to MB3 is provided along the direction D1. Specifically, the memory global line GLM formed of the fifth aluminum interconnect layer ALE is provided from the logic circuit block LB along the direction D1.

More specifically, repeater blocks RP1 to RP3 are disposed in FIG. 20 corresponding to the memory blocks MB1 to MB3. Each of the repeater blocks RP1 to RP3 includes a buffer which buffers at least the write data signal (or address signal or memory control signal) from the logic circuit block LB and outputs the write data signal to the memory blocks MB1 to MB3, respectively. As shown in FIG. 20, the memory blocks MB1 to MB3 and the repeater blocks RP1 to RP3 are adjacently disposed along the direction D1, respectively.

For example, when supplying the write data signal, the address signal, and the memory control signal from the logic circuit block LB to the memory blocks MB1 to MB3 using the memory global line GLM, the rising waveforms and the falling waveforms of these signals are rounded if these signals are not buffered. As a result, the time required for writing data into the memory blocks MB1 to MB3 may be increased, or a write error may occur.

On the other hand, when the repeater blocks RP1 to RP3 shown in FIG. 20 are respectively disposed adjacent to the memory blocks MB1 to MB3 in the direction D1 with respect to the memory blocks MB1 to MB3, for example, the write data signal, the address signal, and the memory control signal are buffered by the repeater blocks RP1 to RP3 and then input to the memory blocks MB1 to MB3. As a result, rounding of the rising waveforms and the falling waveforms of these signals can be reduced, whereby data can be appropriately written into the memory blocks MB1 to MB3.

In FIG. 20, the integrated circuit device includes the grayscale voltage generation circuit block GB which generates the grayscale voltage. A grayscale global line GLG (grayscale voltage supply line) for supplying the grayscale voltage from the grayscale voltage generation circuit block GB to the data driver blocks DB1 to DB3 is provided along the direction D1. Specifically, the grayscale global line GLG formed of the fifth aluminum interconnect layer ALE is provided from the grayscale voltage generation circuit block GB along the direction D1. Grayscale voltage supply lines GSL1 to GSL3 for supplying the grayscale voltage from the grayscale global line GLG to the data drivers DR1 to DR3 are respectively provided in the data drivers DR1 to DR3 along the direction D2.

In FIG. 20, the memory global line GLM is provided between the grayscale global line GLG and the driver global line GLD along the direction D1.

In FIG. 20, the buffer circuits BF1 to BF3 and the row address decoders RD1 to RD3 are disposed along the direction D1. The wiring efficiency can be significantly improved by providing the driver global line GLD along the direction D1 from the logic circuit block LB to pass over the buffer circuits BF1 to BF3 and the row address decoders RD1 to RD3.

It is necessary to supply the grayscale voltage from the grayscale voltage generation circuit block GB to the data drivers DR1 to DR3. Therefore, the grayscale global line GLG is provided along the direction D1.

The address signal, the memory control signal, and the like are supplied to the row address decoders RD1 to RD3 through the memory global line GLM. Therefore, it is desirable to provide the memory global line GLM near the row address decoders RD1 to RD3.

In FIG. 20, the memory global line GLM is provided between the grayscale global line GLG and the driver global line GLD. Therefore, the address signal, the memory control signal, and the like from the memory global line GLM can be supplied to the row address decoders RD1 to RD3 along a short path. The grayscale global line GLG can be provided almost linearly along the direction D1 on the upper side of the memory global line GLM. Accordingly, the global lines GLG, GLM, and GLD can be provided using one aluminum interconnect layer ALE without causing the global lines GLG, GLM, and GLD to intersect, whereby the wiring efficiency can be improved.

In FIG. 20, the grayscale transfer lines GTL are provided over the data driver blocks DB1 to DB3 along the direction D1 using the global lines. In this case, the grayscale adjustment data is transferred by time division through the grayscale transfer lines GTL, as described above. Therefore, the number of grayscale transfer lines GTL (global lines) can be reduced as compared with a method of transferring the grayscale adjustment data at one time using parallel transfer lines. This makes it possible to deal with a situation in which the number of global lines is limited due to an increase in the number of driver, memory, and grayscale global lines GLD, GLM, and GLG. Therefore, a situation can be prevented in which the width of the integrated circuit device in the direction D2 increases due to an increase in the number of grayscale transfer lines GTL, whereby the area of the integrated circuit device can be reduced.

In FIG. 20, power supply transfer lines PTL are provided over the data driver blocks DB1 to DB3 along the direction D1 using the global lines. The logic circuit block LB transfers the power supply adjustment data to the power supply circuit block PB by time division through the m-bit (m is a positive integer) power supply transfer lines PTL. The power supply transfer lines PTL are provided along the direction D1 using the global lines. A power supply global line (not shown) for supplying the power supply voltage from the power supply circuit block PB2 to each circuit block is also provided along the direction D1.

A time division transfer of the power supply adjustment data may be implemented using a method similar to the time division transfer method for the grayscale adjustment data described with reference to FIGS. 18 to 19B. Specifically, a power supply register section 38 and an address decoder (not shown) are provided in the power supply circuit block PB2. The power supply adjustment data may be transferred through the power supply transfer lines PTL by time division and written at each register address of the power supply register section 38.

12. Block Division

Figure 21A:
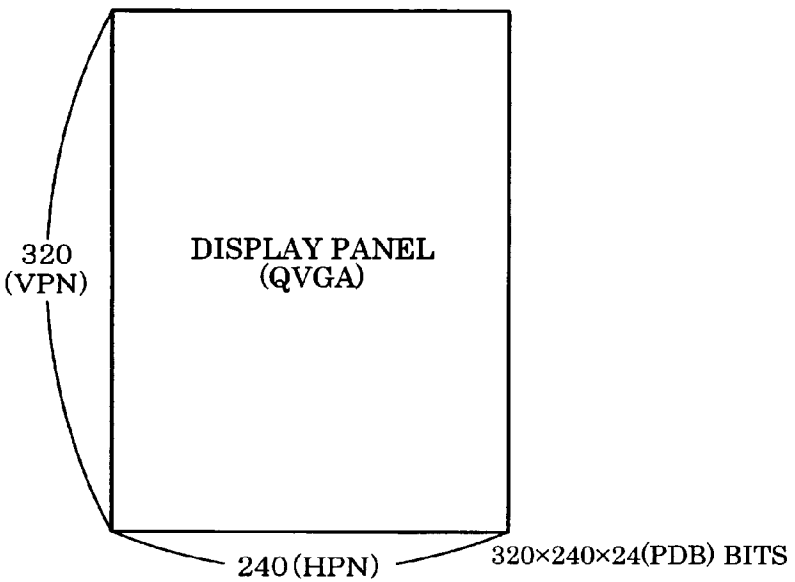
FIGS. 21A and 21B are views illustrative of a block division method for a memory and a data driver.

Suppose that the display panel is a QVGA panel in which the number of pixels in the vertical scan direction (data line direction) is VPN=320 and the number of pixels in the horizontal scan direction (scan line direction) is HPN=240, as shown in FIG. 21A. Suppose that the number of bits PDB of image (display) data of one pixel is PDB=24 bits (8 bits each for R, G, and B). In this case, the number of bits of image data necessary for displaying one frame of the display panel is VPN×HPN×PDB=320×240×24 bits. Therefore, the memory of the integrated circuit device stores at least 320×240×24 bits of image data. The data driver outputs data signals of HPN=240 data lines (data signals corresponding to 240×24 bits of image data) to the display panel in units of horizontal scan periods (in units of periods in which one scan line is scanned).

Figure 21B:
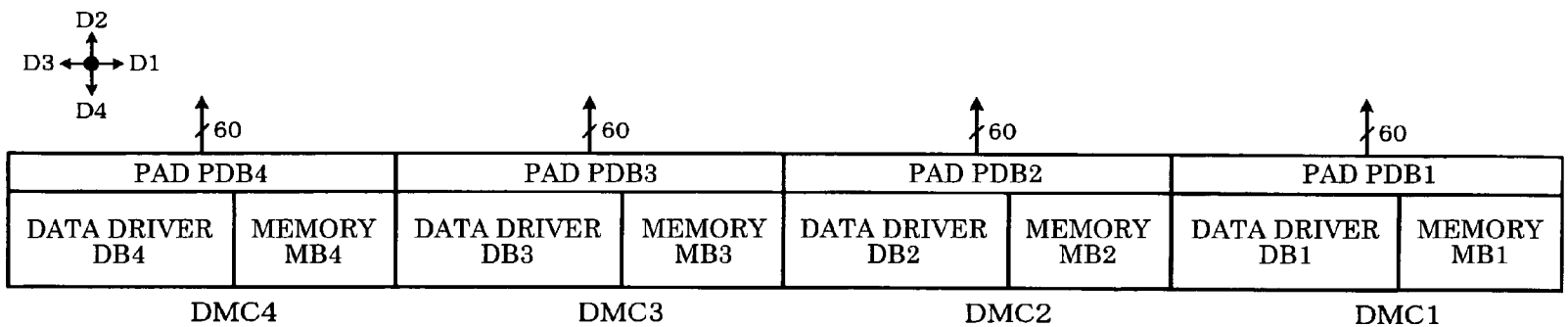

In FIG. 21B, the data driver is divided into four (DBN=4) data driver blocks DB1 to DB4. The memory is also divided into four (MBN=DBN=4) memory blocks MB1 to MB4. Specifically, four driver macrocells DMC1, DMC2, DMC3, and DMC4 are disposed along the direction D1, each of the driver macrocells DMC1, DMC2, DMC3, and DMC4 including the data driver block, the memory block, and the pad block, for example. Therefore, each of the data driver blocks DB1 to DB4 outputs the data signals of 60 (HPN/DBN=240/4=60) data lines to the display panel in units of horizontal scan periods. Each of the memory blocks MB1 to MB4 stores (VPN×HPN×PDB)/MBN=(320×240×24)/4 bits of image data.

13. Readings in One Horizontal Scan Period

In FIG. 21B, each of the data driver blocks DB1 to DB4 outputs the data signals of 60 data lines (60×3=180 data lines when three data lines are provided for R, G, and B) in one horizontal scan period. Therefore, the image data corresponding to the data signals of 240 data lines must be read from the memory blocks MB1 to MB4 corresponding to the data driver blocks DB1 to DB4 in units of horizontal scan periods.

On the other hand, when the number of bits of image data read in units of horizontal scan periods increases, it is necessary to increase the number of memory cells (sense amplifiers) arranged along the direction D2. As a result, the width W of the integrated circuit device in the direction D2 increases, whereby the width of the chip cannot be reduced. Moreover, since the length of the wordline WL increases, a signal delay in the wordline WL occurs.

In order to solve such a problem, it is desirable to employ a method in which the image data stored in the memory blocks MB1 to MB4 is read from the memory blocks MB1 to MB4 into the data driver blocks DB1 to DB4 a plurality of times (RN times) in one horizontal scan period.

Figure 22:
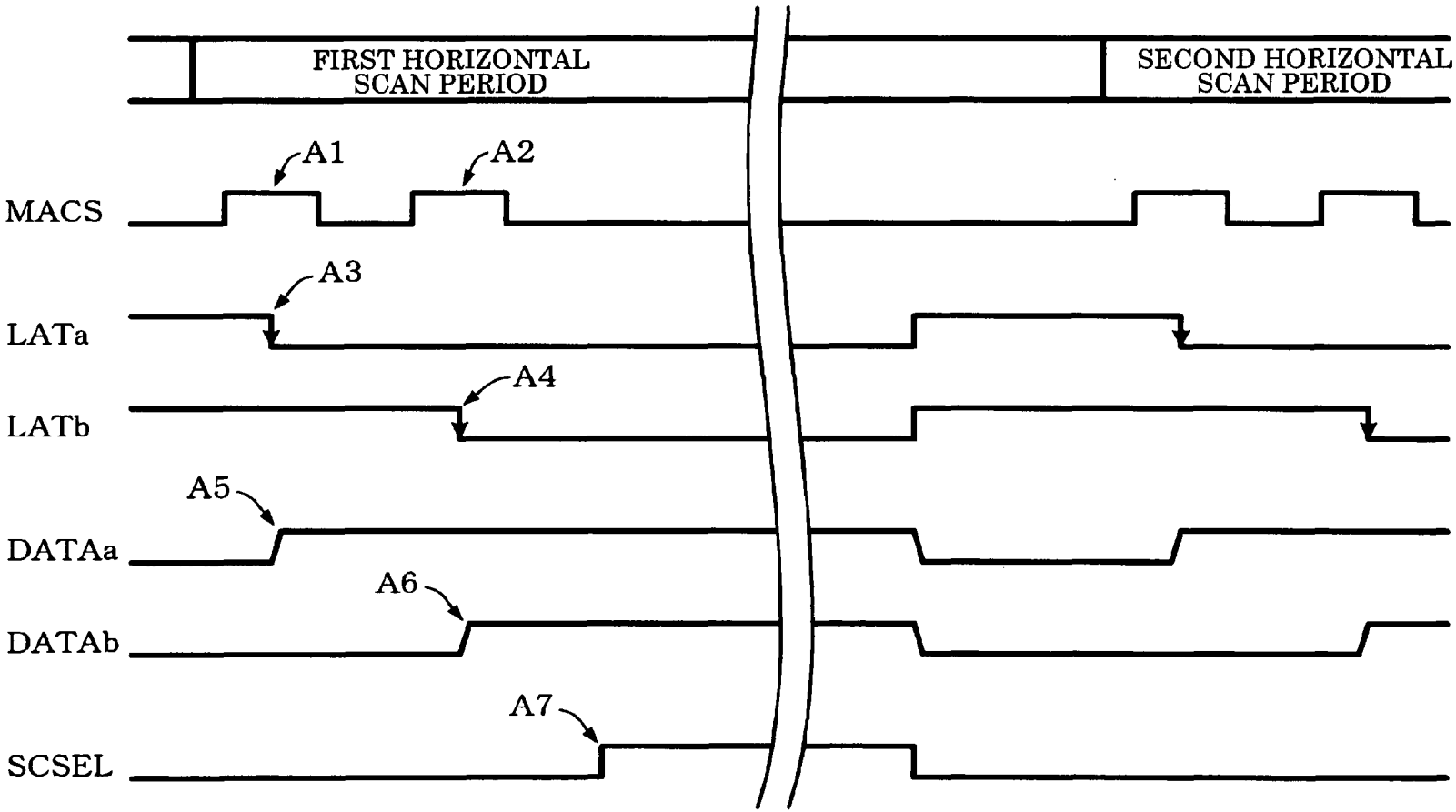
FIG. 22 is a view illustrative of a method of reading image data two or more times in one horizontal scan period.
Figure 23:
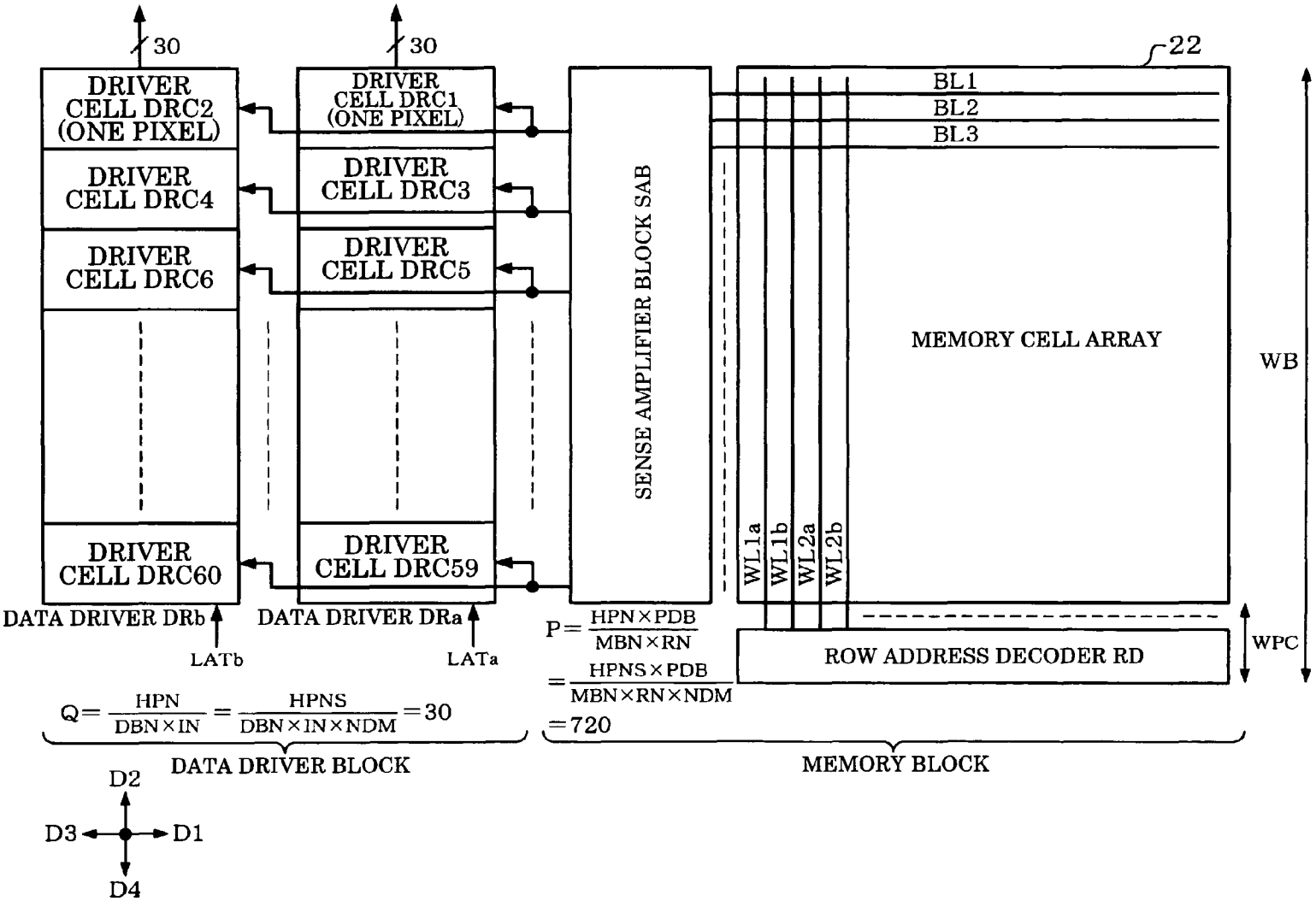
FIG. 23 shows an arrangement example of data drivers and driver cells.

In FIG. 22, a memory access signal MACS (word select signal) goes active (high level) twice (RN=2) in one horizontal scan period, as indicated by A1 and A2, for example. This causes the image data to be read from each memory block into each data driver block twice (RN=2) in one horizontal scan period. Then, data latch circuits of data drivers DRa and DRb shown in FIG. 23 provided in the data driver block latch the read image data based on latch signals LATa and LATb indicated by A3 and A4. Multiplexers of the data drivers DRa and DRb multiplex the latched image data, and D/A converters of the data drivers DRa and DRb subject the multiplexed image data to D/A conversion. Output circuits of the data drivers DRa and DRb output data signals DATAa and DATAb obtained by D/A conversion, as indicated by A5 and A6. A scan signal SCSEL input to the gate of the TFT of each pixel of the display panel goes active, as indicated by A7, and the data signal is input to and held by each pixel of the display panel.

In FIG. 22, the image data is read twice in the first horizontal scan period, and the data signals DATAa and DATAb are output to the data signal output line in the first horizontal scan period. Note that the image data may be read twice and latched in the first horizontal scan period, and the data signals DATAa and DATAb corresponding to the latched image data may be output to the data signal output line in the second horizontal scan period. FIG. 22 shows the case where the read count is RN=2. Note that the read count RN may be equal to or larger than three (RN≧3).

According to the method shown in FIG. 22, the image data corresponding to the data signals of 30 data lines is read from each memory block, and each of the data drivers DRa and DRb outputs the data signals of 30 data lines, as shown in FIG. 23. This allows the data signals of 60 data lines to be output from each data driver block. As described above, it suffices that the image data corresponding to the data signals of 30 data lines be read from each memory block in one read operation in FIG. 22. Therefore, the numbers of memory cells and sense amplifiers in the direction D2 in FIG. 23 can be reduced as compared with a method of reading the image data only once in one horizontal scan period. As a result, the width of the integrated circuit device in the direction D2 can be reduced, whereby a narrow chip can be realized. In particular, one horizontal scan period is about 52 microseconds in a QVGA display panel. On the other hand, the memory read time is about 40 nanoseconds, which is sufficiently shorter than 52 microseconds. Therefore, even if the read count in one horizontal scan period is increased from one to two or more, the display characteristics are not affected to a large extent.

FIG. 21A shows a QVGA (320×240) display panel. It is possible to deal with a VGA (640×480) display panel by increasing the read count in one horizontal scan period to four (RN=4), for example, whereby the degrees of freedom of the design can be increased.

Readings in one horizontal scan period may be achieved using a first method in which the row address decoder (wordline select circuit) selects different wordlines in each memory block in one horizontal scan period or a second method in which the row address decoder (wordline select circuit) selects a single wordline in each memory block a plurality of times in one horizontal scan period. Alternatively, readings in one horizontal scan period may be achieved by combining the first method and the second method.

In FIG. 23, the data driver block includes the data drivers DRa and DRb arranged along the direction D1. Each of the data drivers DRa and DRb includes driver cells.

When the wordline WL1*a* of the memory block has been selected and the first image data has been read from the memory block, as indicated by A1 in FIG. 22, the data driver DRa latches the read image data based on the latch signal LATa indicated by A3, and multiplexes the latched image data. The data driver DRa subjects the multiplexed image data to D/A conversion, and outputs the data signal DATAa corresponding to the first image data, as indicated by A5.

When the wordline WL1*b* of the memory block has been selected and the second image data has been read from the memory block, as indicated by A2 in FIG. 22, the data driver DRb latches the read image data based on the latch signal LATb indicated by A4, and multiplexes the latched image data. The data driver DRb subjects the multiplexed image data to D/A conversion, and outputs the data signal DATAb corresponding to the second image data, as indicated by A6.

Each of the data drivers DRa and DRb outputs the data signals of 30 data lines corresponding to 30 pixels as described above, whereby the data signals of 60 data lines corresponding to 60 pixels are output in total.

A situation in which the width W of the integrated circuit device in the direction D2 increases due to an increase in the scale of the data driver can be prevented by disposing (stacking) the data drivers DRa and DRb along the direction D1, as shown in FIG. 23. The data driver is configured in various ways depending on the type of display panel. In this case, data drivers of various configurations can be efficiently arranged using the method of disposing the data drivers along the direction D1. FIG. 23 shows the case where the number of data drivers disposed along the direction D1 is two. Note that three or more data drivers may be disposed along the direction D1.

In FIG. 23, each of the data drivers DRa and DRb includes 30 (Q) driver cells disposed along the direction D2. In FIG. 23, the number of pixels of the display panel in the horizontal scan direction (the number of pixels in the horizontal scan direction driven by each integrated circuit device when two or more integrated circuit devices cooperate to drive the data lines of the display panel) is referred to as HPN, the number of data driver blocks (number of block divisions) is referred to as DBN, and the input count of image data to the driver cell in one horizontal scan period is referred to as IN. The input count IN is equal to the image data read count RN in one horizontal scan period described with reference to FIG. 22. In this case, the number Q of driver cells may be expressed as Q=HPN/(DBN×IN). In FIG. 23, since HPN=240, DBN=4, and IN=2, Q=240/(4×2)=30.

The number of subpixels of the display panel in the horizontal scan direction is referred to as HPNS, and the degree of multiplexing of the multiplexer of each driver cell is referred to as NDM. In this case, the number Q of driver cells disposed along the direction D2 may be expressed as Q=HPNS/(DBN×IN×NDM). In FIG. 23, since HPNS=240×3=720, DBN=4, IN=2, and NDM=3, Q=720/(4×2×3)=30. For example, when the degree of multiplexing is increased to NDM=6, Q=720/(4×2×6)=15.

When the width (pitch) of the driver cells in the direction D2 is referred to as WD and the width of the peripheral circuit section (e.g. buffer circuit and wiring region) of the data driver block in the direction D2 is referred to as WPCB, the width WB (maximum width) of the first to Nth circuit blocks CB1 to CBN in the direction D2 may be expressed as Q×WD≦WB<(Q+1)×WD+WPCB. When the width of the peripheral circuit section (e.g. row address decoder RD and wiring region) of the memory block in the direction D2 is referred to as WPC, the width WB (maximum width) of the first to Nth circuit blocks CB1 to CBN in the direction D2 may be expressed as Q×WD≦WB<(Q+1)×WD+WPC.

When the number of pixels of the display panel in the horizontal scan direction is referred to as HPN, the number of bits of image data of one pixel is referred to as PDB, the number of memory blocks is referred to as MBN (=DBN), and the read count of image data from the memory block in one horizontal scan period is referred to as RN. In this case, the number of sense amplifiers (sense amplifiers which output one bit of image data) arranged in the sense amplifier block SAB along the direction D2 may be expressed as P=(HPN×PDB)/(MBN×RN). In FIG. 23, since HPN=240, PDB=24, MBN=4, and RN=2, P=(240×24)/(4×2)=720. The number P is the number of effective sense amplifiers corresponding to the number of effective memory cells, and excludes the number of ineffective sense amplifiers such as sense amplifiers for dummy memory cells.

The number of subpixels of the display panel in the horizontal scan direction is referred to as HPNS, and the degree of multiplexing of the multiplexer of each driver cell is referred to as NDM. In this case, the number P of sense amplifiers disposed along the direction D2 may be expressed as P=(HPNS×PDB)/(MBN×RN×NDM). In FIG. 23, since HPNS=240×3=720, PDB=24, MBN=4, RN=2, and NDM=3, P=(720×24)/(4×2×3)=720.

When the width (pitch) of each sense amplifier of the sense amplifier block SAB in the direction D2 is referred to as WS, the width WSAB of the sense amplifier block SAB (memory block) in the direction D2 may be expressed as WSAB=PXWS. When the width of the peripheral circuit section of the memory block in the direction D2 is referred to as WPC, the width WB (maximum width) of the circuit blocks CB1 to CBN in the direction D2 may also be expressed as P×WS≦WB<(P+PDB)×WS+WPC.

14. Electronic Instrument

Figure 24A:
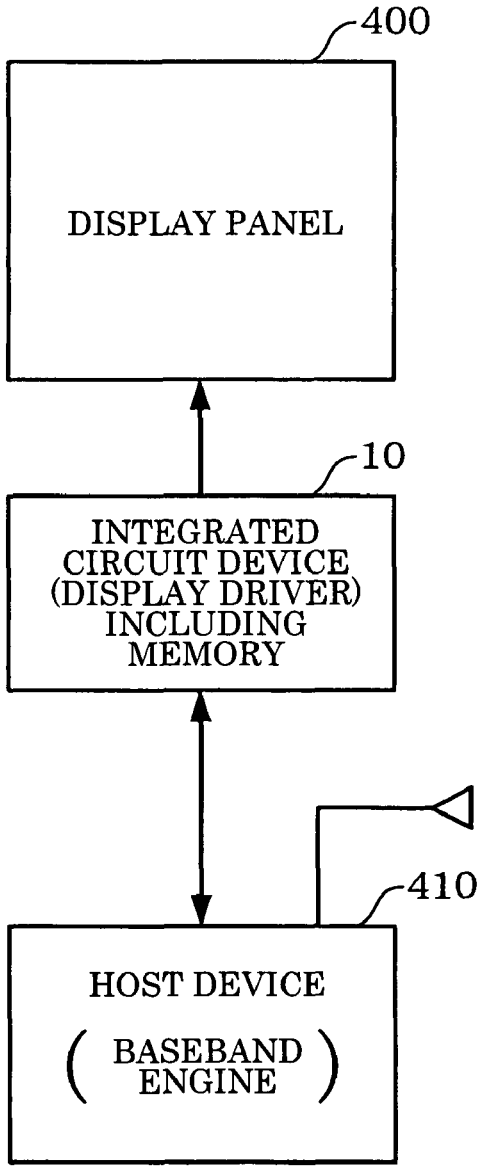
FIGS. 24A and 24B show configuration examples of an electronic instrument.
Figure 24B:
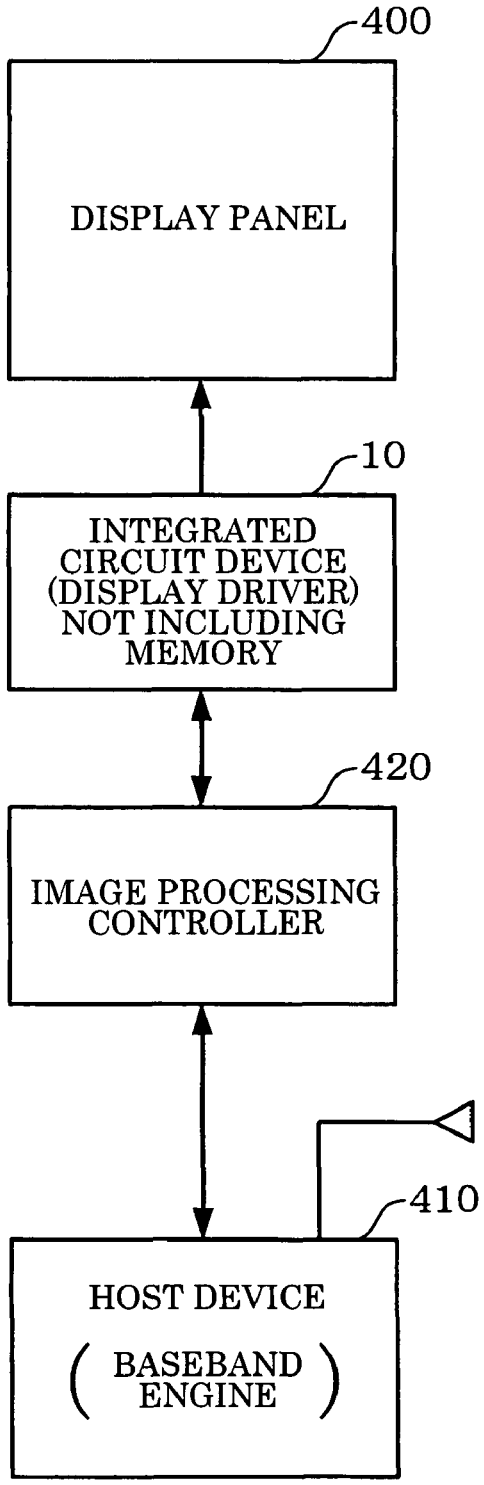

FIGS. 24A and 24B show examples of an electronic instrument (electro-optical device) including the integrated circuit device 10 according to this embodiment. The electronic instrument may include elements (e.g. camera, operation section, or power supply) other than the elements shown in FIGS. 24A and 24B. The electronic instrument according to this embodiment is not limited to a portable telephone, but may be a digital camera, a PDA, an electronic notebook, an electronic dictionary, a projector, a rear-projection television, a portable information terminal, or the like.

In FIGS. 24A and 24B, a host device 410 is an MPU, a baseband engine, or the like. The host device 410 controls the integrated circuit device 10 (display driver). The host device 410 may also perform a process of an application engine or a baseband engine or a process of a graphic engine, such as compression, decompression, and sizing. An image processing controller 420 shown in FIG. 24B performs a process of a graphic engine, such as compression, decompression, or sizing, instead of the host device 410.

In FIG. 24A, an integrated circuit device including a memory may be used as the integrated circuit device 10. In this case, the integrated circuit device 10 writes image data from the host device 410 into the memory, reads the image data from the built-in memory, and drives the display panel. In FIG. 24B, an integrated circuit device which does not include a memory may be used as the integrated circuit device 10. In this case, image data from the host device 410 is written into a built-in memory of the image processing controller 420. The integrated circuit device 10 drives the display panel 400 under control of the image processing controller 420.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g., output-side I/F region, input-side I/F region, liquid crystal element, first substrate, and second substrate) cited with a different term (e.g., first interface region, second interface region, electro-optical element, array substrate, and common substrate) having a broader meaning or the same meaning at least once in the specification and the drawings can be replaced by the different term in any place in the specification and the drawings. The method of disposing the physical layer circuit described with reference to FIGS. 1 to 6B, the method of providing the common voltage line in the integrated circuit device described with reference to FIGS. 8A to 11C, and the method of providing the panel common voltage line described with reference to FIG. 12 may be applied not only to the integrated circuit device having the configuration described with reference to FIGS. 15 to 17A, but also to integrated circuit devices having other arrangement configurations. For example, these methods may also be applied to the integrated circuit device having the arrangement configuration shown in FIG. 17B. The method of mounting the integrated circuit device is not limited to the method described with reference to FIG. 4 and the like.

What is claimed is:

1. A display device comprising:

an integrated circuit device; and a display panel that is driven by the integrated circuit device, the integrated circuit device being mounted on the display panel, the display panel including:

a panel test terminal that is used to test the display panel; and a driver output terminal that is electrically connected with a data driver pad of the integrated circuit device and is electrically connected with the panel test terminal, the integrated circuit device including:

at least one data driver block that drives a data line of the display panel; and a high-speed interface circuit block that includes a physical layer circuit and receives data through a serial bus using differential data signals, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel, the high-speed interface circuit block including a link controller that performs a link layer process, the link controller being disposed in a region that overlaps the predetermined test terminal region, when a direction from a first side that is a short side of the integrated circuit device toward a third side opposite to the first side is referred to as a first direction and a direction from a second side that is a long side of the integrated circuit device toward a fourth side opposite to the second side, is referred to as a second direction, the link controller being disposed in the second direction with respect to the physical layer circuit, and the driver output terminal being disposed in the second direction with respect to the panel test terminal, and the data driver block being disposed in a third direction with respect to the link controller and the physical layer circuit.

2. An electronic instrument comprising the display device as defined in claim 1.

3. An integrated circuit device that is mounted on a display device and drives the display device, the integrated circuit device comprising:

at least one data driver block that drives a data line of the display panel; and a high-speed interface circuit block that includes a physical layer circuit and receives data through a serial bus using differential data signals, the display device including:

a panel test terminal that is used to test the display panel; and a driver output terminal that is electrically connected with a data driver pad of the integrated circuit device and is electrically connected with the panel test terminal, the physical layer circuit being disposed in the integrated circuit device so that the physical layer circuit non-overlaps a predetermined test terminal region, the predetermined test terminal region being a region in which the panel test terminal is predetermined to locate under the integrated circuit device when the integrated circuit device is mounted on the display panel, the high-speed interface circuit block including a link controller that performs a link layer process, the link controller being disposed in a region that overlaps the predetermined test terminal region, when a direction from a first side that is a short side of the integrated circuit device toward a third side opposite to the first side is referred to as a first direction and a direction from a second side that is a long side of the integrated circuit device toward a fourth side opposite to the second side is referred to as a second direction, the link controller being disposed in the second direction with respect to the physical layer circuit, and the driver output terminal being disposed in the second direction with respect to the panel test terminal, and the data driver block being disposed in a third direction with respect to the link controller and the physical layer circuit.

4. An electronic instrument comprising: the integrated circuit device as defined in claim 3; and the display panel driven by the integrated circuit device.

* * * * *